US010486898B2

(12) United States Patent
Bonerb

(10) Patent No.: US 10,486,898 B2
(45) Date of Patent: Nov. 26, 2019

(54) FLEXIBLE LINER SYSTEM FOR DISCHARGING AND AERATING DRY MATERIALS IN A STORAGE BIN

(71) Applicant: Timothy C. Bonerb, Stinson Beach, CA (US)

(72) Inventor: Timothy C. Bonerb, Stinson Beach, CA (US)

( * ) Notice: Subject to any disclaimer, the term of this patent is extended or adjusted under 35 U.S.C. 154(b) by 0 days.

(21) Appl. No.: 15/749,882

(22) PCT Filed: Aug. 4, 2016

(86) PCT No.: PCT/US2016/045658
§ 371 (c)(1),
(2) Date: Feb. 2, 2018

(87) PCT Pub. No.: WO2017/024184
PCT Pub. Date: Feb. 9, 2017

(65) Prior Publication Data

US 2018/0222670 A1 Aug. 9, 2018

Related U.S. Application Data

(60) Provisional application No. 62/493,366, filed on Jul. 1, 2016, provisional application No. 62/390,226, filed on Mar. 23, 2016, provisional application No. 62/389,656, filed on Mar. 7, 2016, provisional application No. 62/283,325, filed on Aug. 28, 2015, provisional application No. 62/282,562, filed on Aug. 5, 2015.

(51) Int. Cl.

| | |
|---|---|
| ***B65D 88/62*** | (2006.01) |
| ***B65D 88/72*** | (2006.01) |
| ***B65D 90/04*** | (2006.01) |

(52) U.S. Cl.
CPC ..... *B65D 88/62* (2013.01); *B65D 88/72* (2013.01); *B65D 90/046* (2013.01); *B65D 2590/547* (2013.01)

(58) Field of Classification Search
CPC ..... B65B 88/62; B65B 88/72; B65D 90/046; B65G 65/46

(Continued)

(56) References Cited

U.S. PATENT DOCUMENTS 2,931,523 A * 4/1960 Nelligan ..... B65D 88/62 105/260
3,139,998 A * 7/1964 Seaman ..... B61D 5/004 37/431

(Continued)

FOREIGN PATENT DOCUMENTS

FR 2810648 12/2001
JP 57-209121 12/1982

(Continued)

OTHER PUBLICATIONS

International Search Report and Written Opinion for corresponding International application No. PCT/US2016/045658 dated Oct. 21, 2016 pp. 9.

*Primary Examiner* — Kaitlin S Joerger
(74) *Attorney, Agent, or Firm* — Bryan Wheelock

(57) ABSTRACT

A flexible liner system for a silo receiving and storing granular materials, in which the flexible liner system includes a first flexible inflate liner and a second flexible inflate liner placed in the silo and aligned respectively against a silo wall and a silo floor. The first inflate liner and the second inflate liner are separated from each other by a central trough that extends completely across or substantially completely across the silo floor. The flexible liner system includes a conveyor assembly that inflates each inflate liner to push the granular material toward the central trough and aerates the granular material stored in the silo. The flexible liner system further includes a liner return (Continued)

system that allows each inflate liner to be brought back against the wall and the floor of the silo during deflation.

20 Claims, 17 Drawing Sheets

(58) Field of Classification Search
USPC ..... 414/326
See application file for complete search history.

(56) References Cited

U.S. PATENT DOCUMENTS 3,664,935 A * 5/1972 Johnson ..... C25C 3/06 204/245
4,449,646 A * 5/1984 Bonerb ..... B65D 88/62 222/105
RE32,232 E * 8/1986 Bonerb ..... B65D 88/62 222/105
4,603,795 A * 8/1986 Bonerb ..... B65D 88/62 222/262
5,797,480 A * 8/1998 Gaddis ..... B60P 1/40 198/672
7,597,525 B2 * 10/2009 McMahon ..... B65D 90/046 141/65
8,141,750 B2 * 3/2012 Ingvarsson ..... B65G 65/46 222/203
2007/0048113 A1 * 3/2007 McMahon ..... B65D 88/62 414/467

FOREIGN PATENT DOCUMENTS

WO WO-1982/03839 11/1982
WO WO-2018148343 A1 * 8/2018 ..... B65D 88/62

* cited by examiner

FLEXIBLE LINER SYSTEM FOR DISCHARGING AND AERATING DRY MATERIALS IN A STORAGE BIN

FIELD OF THE DISCLOSURE

This invention relates to improvements for handling, storing, aerating and discharging dry bulk materials, such as feed and grain, from flat-bottom and hopper bottom storage silos.

BACKGROUND

For the last hundred plus years, storage bins and silos with flat-bottom floors have been used to store free flowing granular material, such as grain, salt, and sugar. In order to discharge the granular material out of the silo more effectively, many designs have been implemented with the flat-bottom floors of the storage bins and silos. The vast majority of these designs include the use of an exposed sweep auger for emptying the grain. Because one or more workers are usually needed to be inside the silo to carry out the unloading process while the exposed sweep auger is operating, the process of discharging the grain from the silo becomes dangerous.

Some prior art has used pneumatically movable flexible membranes to discharge the grain from the silo, such as a single flexible cup-shaped bag surrounding a central discharge opening. However, by only using a single bag to convey the grain within the silo, high pressure of air is maintained against the entire surface area of the cup-shaped bag during the unloading process, including a section of the bag not exposed to a load of bulk material. Consequently, a fully inflated segment of the bag forms during the initial stage of inflation and grows within the silo before full inflation of the bag is achieved. The fully inflated section creates an improper load balance along the surface of the bag, which places significant stresses on the silo wall, the exposed liner, and the clamp bar assemblies. These stresses may cause the silo wall to be pulled inward and seams on the liner to tear and rupture. Ultimately, the clamp bar assembly becomes bent and pulled away from the mounting surface along the silo wall, resulting in a leaky joint.

The inflated sections of the bag not exposed to bulk material also form folds between the segments of the liner during the initial stage of inflation. These folds trap the free flowing granular material, thereby hindering the flow of the granular material. As a result, the single flexible cup-shaped bag is not able to completely cleanout the granular material. Furthermore, a single bag design is difficult to be implemented in larger-sized silos, such as silos having diameters over 18 feet, because as the outer perimeter of the bag increases with respect to the diameter of the central discharge hole, the bag tends to fold, wrinkle and form a strong vacuum between the liner of the bag and the silo floor during deflation. The folding and wrinkling makes the liner return to the silo wall in an aligned manner virtually impossible.

Accordingly, there is a need for a discharge system that is scalable for larger-sized silos without the need for a sweep auger to convey the granular material.

SUMMARY

The present invention provides a flexible liner system for a silo receiving and storing granular materials, in which the flexible liner system includes a first flexible inflate liner and a second flexible inflate liner placed in the silo and aligned respectively against a silo wall and a silo floor. The first inflate liner and the second inflate liner are separated from each other by a central trough that extends completely across or substantially completely across the silo floor. Silo clamp bar assemblies and secure one edge of the inflate liners, respectively, against the silo wall. Another edge of the first inflate liner and the second inflate liner, respectively, are secured to or adjacent to a respective edge of the central trough formed by a conveyor assembly, thereby dividing the grain silo into two liner air compartments. The conveyor assembly includes conveyor housings and an auger installed in between the housings in the center of grain silo. However, other types of conveyors may may be implemented with the conveyor aeration assembly, including an air slide, a belt, and a chain.

Each inflate liner is configured to be inflated to form an inflated wall extending parallel to the central trough, in which the inflated wall pushes the granular material toward the central trough without a segment of the liner becoming fully inflated. After unloading the granular material to the trough, the flexible liner system includes a liner return system configured to return each inflate liner back toward the wall and floor of the silo, thereby allowing the silo to be loaded with a second load of granular material without the need of workers entering the storage silo to untangle and pull the liner back to the wall.

By moving in the form of an inflated wall that runs parallel to the central trough, the flexible liner system is able to maintain equal loading when pushing the granular material toward the central trough, thereby improving the flowing conditions of the granular material and reducing stress on the silo wall and liner components. Furthermore, by separating two inflate liners with a central trough comprising multiple collection wells, the flexible liner system is scalable to larger silos compared to the other flexible membrane systems of the prior art.

Other features and characteristics of the subject matter of this disclosure, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various embodiments of the subject matter of this disclosure. In the drawings, like reference numbers indicate identical or functionally similar elements.

DETAILED DESCRIPTION

Figure 1:
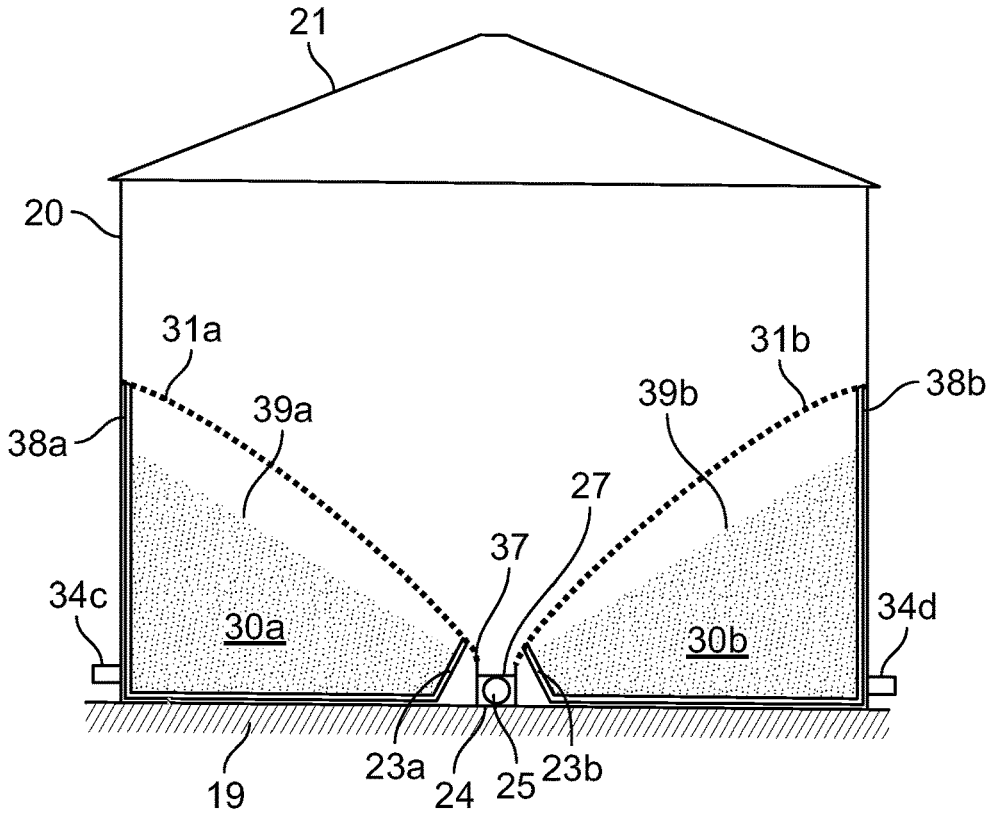
FIG. 1 is a side section view of the Grain Silo divided into liner air compartments.

While aspects of the subject matter of the present disclosure may be embodied in a variety of forms, the following description and accompanying drawings are merely intended to disclose some of these forms as specific examples of the subject matter. Accordingly, the subject matter of this disclosure is not intended to be limited to the forms or embodiments so described and illustrated.

Unless defined otherwise, all terms of art, notations and other technical terms or terminology used herein have the same meaning as is commonly understood by one of ordinary skill in the art to which this disclosure belongs. All patents, applications, published applications and other publications referred to herein are incorporated by reference in their entirety. If a definition set set forth in this section is contrary to or otherwise inconsistent with a definition set forth in the patents, applications, published applications, and other publications that are herein incorporated by reference, the definition set forth in this section prevails over the definition that is incorporated herein by reference.

FIGS. 1 to 9 are side section views of a grain silo 17 incorporating a flexible liner system according to an example embodiment of the present invention. The flexible liner system is adapted to align within an interior surface of a storage bin, such as a grain silo, to move dry bulk material to and through a centrally located conveyor and aerate the dry bulk material while being stored in the storage bin. The grain silo 17 according to the example embodiment comprises a silo floor 22 resting on a foundation 19 and a silo roof 21 displaced above the silo floor 22 with a silo wall 20 extending in between to define cylindrical shaped storage space for grain 39.

In FIG. 1, the flexible liner system according to one embodiment generally includes a first flexible inflate liner 38*a* and a second flexible inflate liner 38*b* placed in the grain silo 17 and aligned respectively against the silo wall 20 and the silo floor 22. The first inflate liner 38*a* and the second inflate liner 38*b* are separated from each other by a central trough that extends completely across or substantially completely across the silo floor 22. Silo clamp bar assemblies 31*a* and 31*b* secure one edge of the inflate liners 38*a* and 38*b*, respectively, against the silo wall 20. Another edge of the first inflate liner 38*a* and the second inflate liner 38*b*, respectively, are secured to an respective edge of the central trough formed by a conveyor aeration assembly 37, thereby dividing the grain silo 17 into two liner air compartments 30*a* and 30*b*. The conveyor aeration assembly 37 includes conveyor housings 23*a* and 23*b* and an auger 26 installed in between the housings 23*a*, 23*b* on the foundation 19 in the center of grain silo 17. However, other types of conveyors may be implemented with the conveyor aeration assembly, including an air slide, a belt, and a chain, without departing from the scope of the present invention. As shown, the silo wall 20 and foundation 19 are integral in providing the support and air tightness for liners 38*a* and 38*b* to be inflated under low air pressure.

Figure 2:
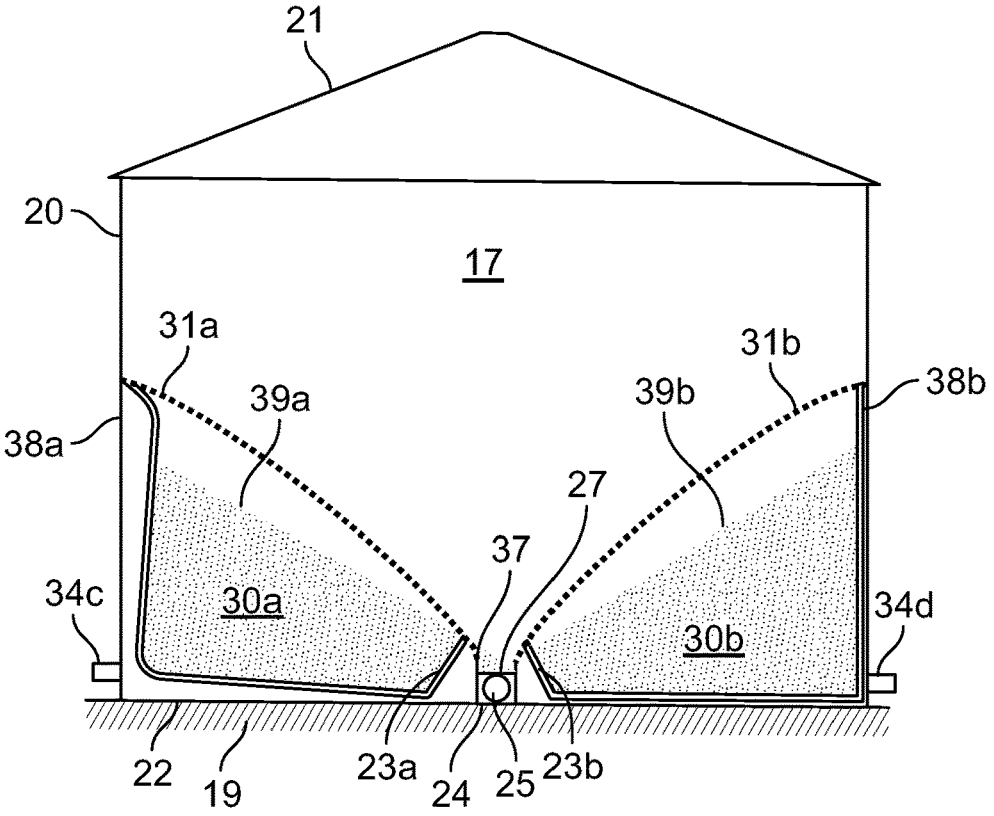
FIG. 2 is a side section view of the Grain Silo with Inflate Liner starting to Inflate.

At the beginning of the unloading process, a center well of the auger 26 is opened to receive free flowing grain moved simply by gravity. During this initial stage of the unloading process, the inflate liners 38*a*, 38*b* are at rest. However, the free flowing of grain 39*a* comes to a stop when the grain 39*a* remains in the silo 19 at an angle of repose. Then, as shown in FIG. 2, the inflate liner 38*a* begins inflating via liner inflation port 34*c* causing grain 39*a* to begin rolling past its angle of repose so that it will flow and flood auger 26 for unloading. Typically during the grain unloading process, inflate liners 38*a* and 38*b* are not operated at the same time but rather sequentially where inflate liner 38*a* is operated first.

Figure 3:
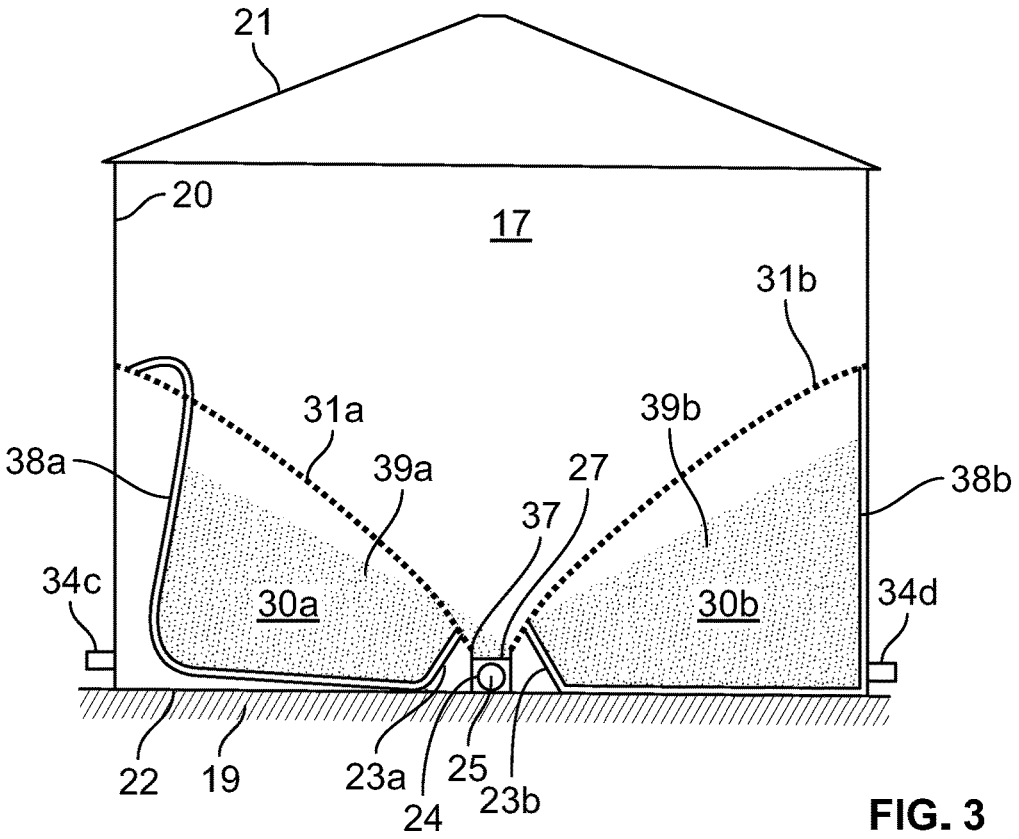
FIG. 3 is a side section view of the Grain Silo with Inflate Line continues to inflate.

As shown in FIG. 3, the first inflate liner 38*a* continues to be inflated, usually under the control of an operator using a remote switch to turn the blower on and off, to gently feed auger 26. For best results and to avoid backups and spill overs, operator will operate inflate liner 38*a* so that grain 39*a* is at a relatively shallow level above auger openings without starving it. As shown, in this configuration, silo wall clamp bar assembly 31*a* is located above the angle of repose of grain 39*a* at an approximate angle of 45 degrees from silo floor. As inflate liner 38*a* expands and rolls and pushes grain 39*a* to auger 26, it rises above silo clamp bar assembly 31*a*. Here, the inflatable liner 38*a* does not lift the grain. Instead, the inflatable liner 38*a* is pushing the grain to the center trough, thereby preventing potential flow problems with the liner and maintaining low air pressure.

Figure 4:
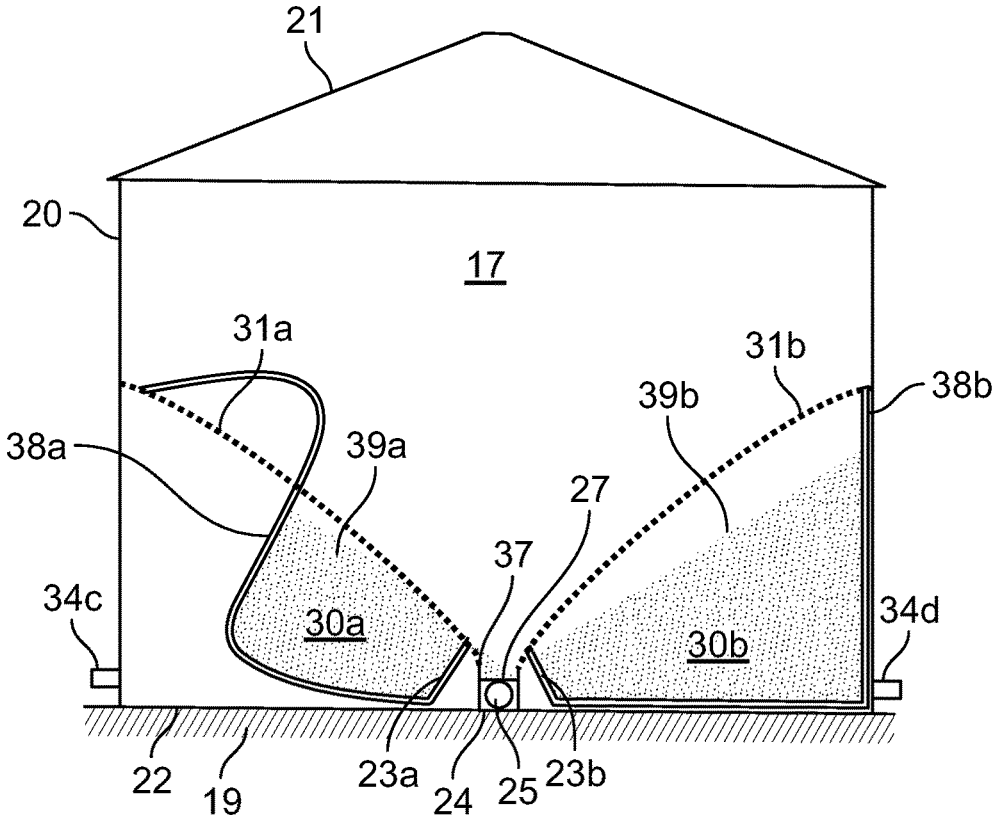
FIG. 4 is a side section view of the Grain Silo with Inflate Liner continues to inflate.
Figure 5:
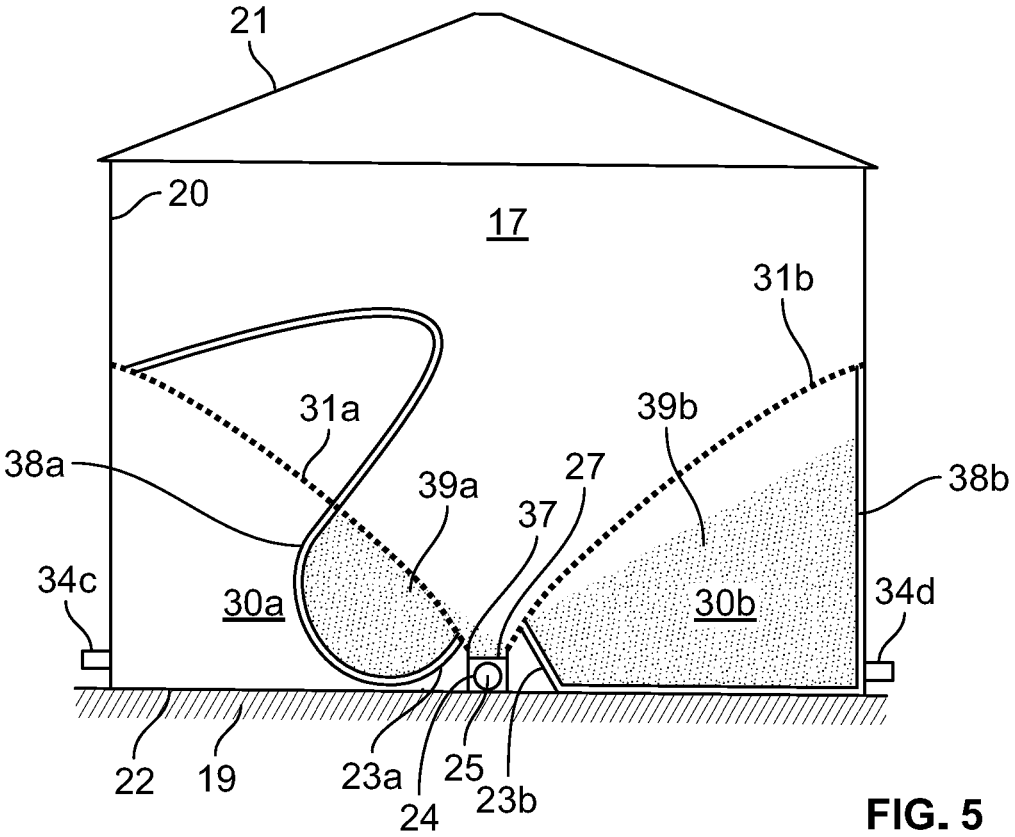
FIG. 5 is a side section view of the Grain Silo with final unload of Liner.
Figure 6:
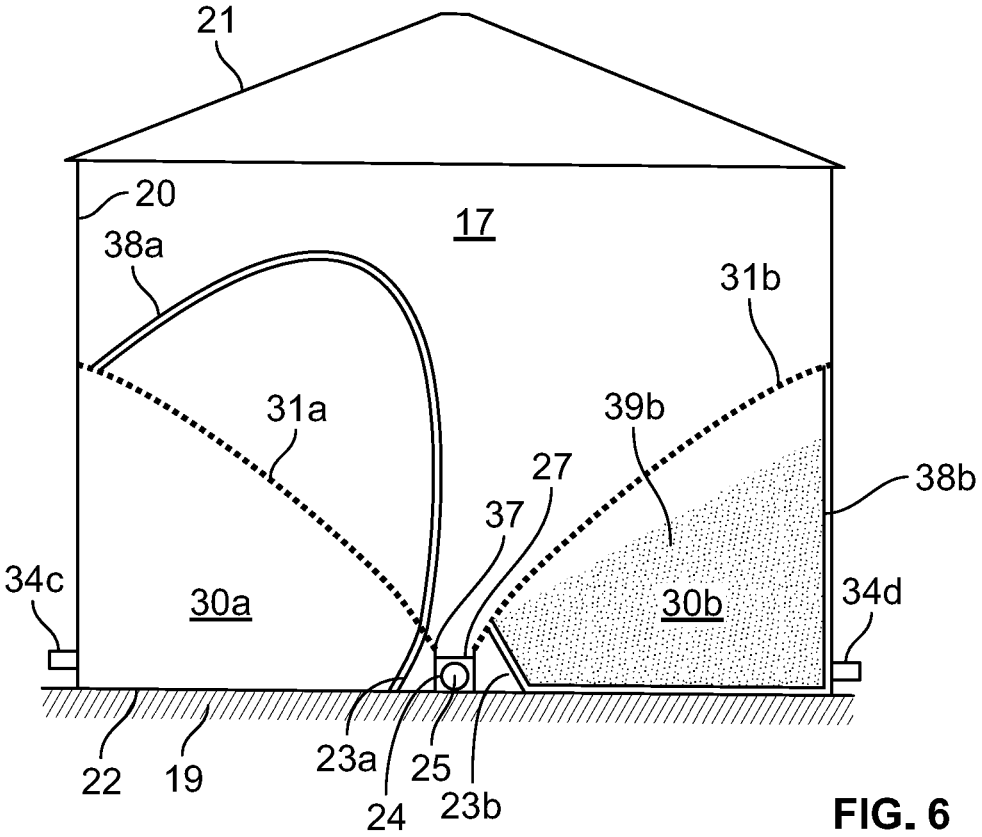
FIG. 6 is a side section view of the Grain Silo with all grain emptied on Inflate Liner.

In FIG. 4, inflate liner 38*a* continues to inflate and is at a point in the unloading process that the inflate compartment 30*a* is about half completed. As the inflation pressure has peaked and now begins to drop, a small load of grain remains on the liner. At this point, other wells along the convey aeration assembly 37 are opened and receiving free flowing grain 39*a*. The sequential opening of the other wells along the convey aeration assembly 37 enables the first inflate liner 38*a* to form a shape of an inflated wall that moves parallel with the central trough. By moving in the shape of an inflated wall, the first inflate liner 38*a* is able to push the grain 39*a* to the center trough, rather than lifting the grain 39*a*. FIGS. 5 and 6 show the first inflate liner 38*a* moving through the final unloading process, whereby all of the grain 39*a* will be emptied from inflate compartment 30*a*.

Figure 7:
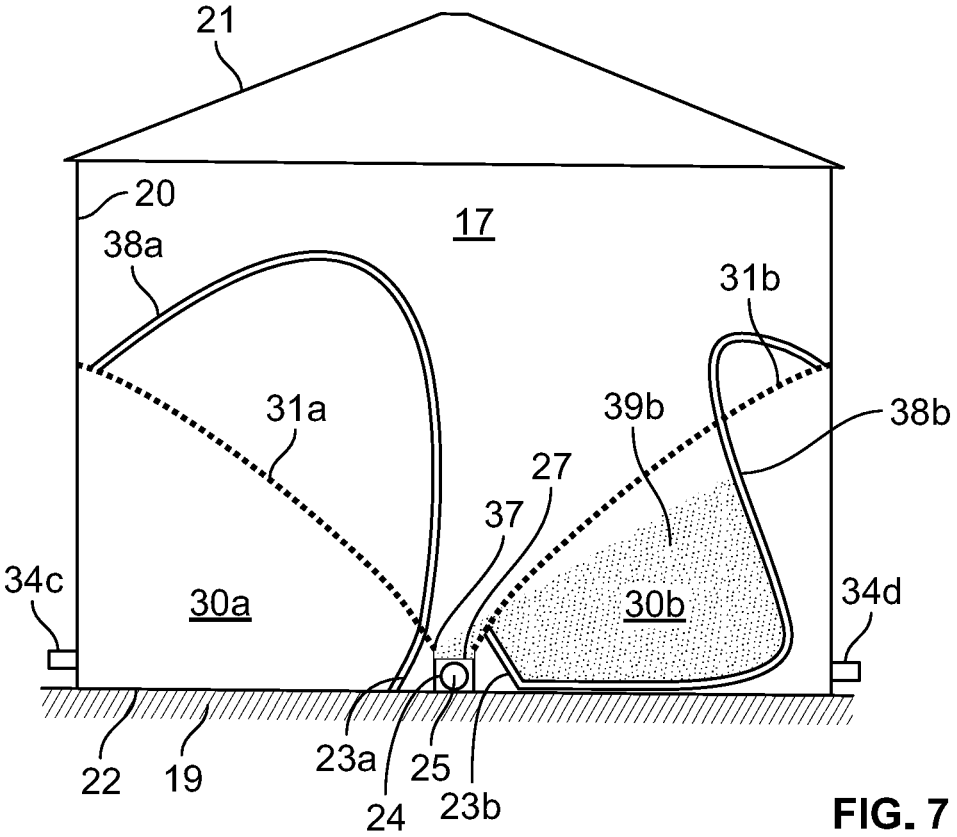
FIG. 7 is a side section view of the Grain Silo with Inflate Liner starting to Inflate.
Figure 8:
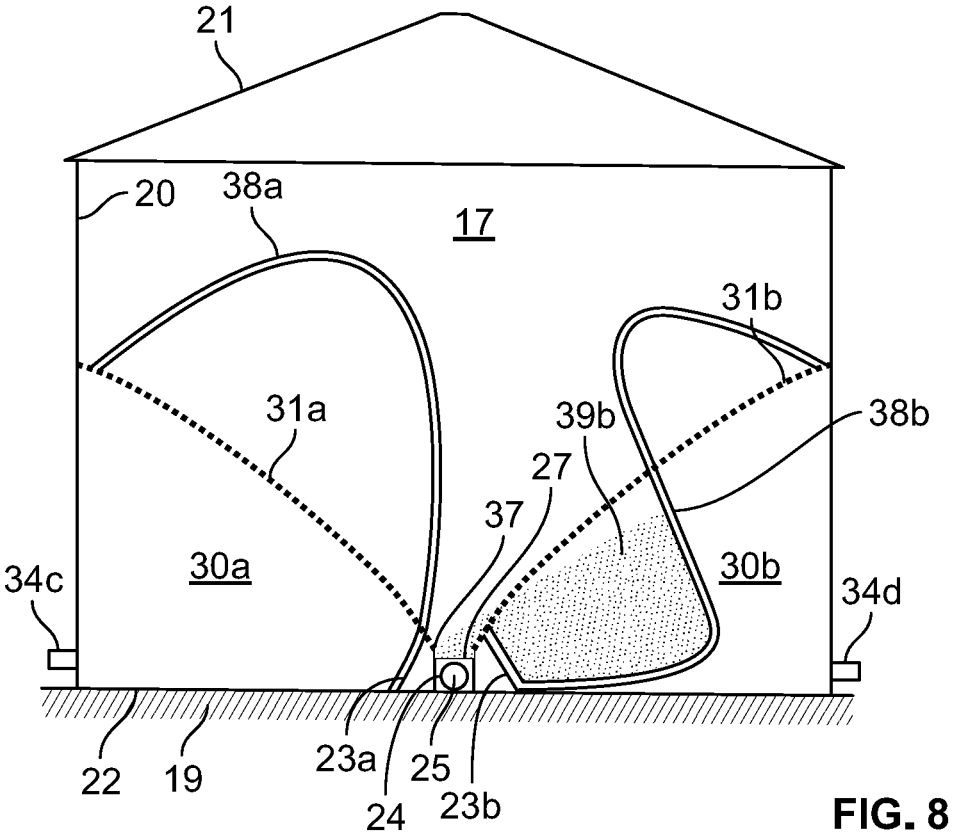
FIG. 8 is a side section view of the Grain Silo with Inflate Line continues to inflate.
Figure 9:
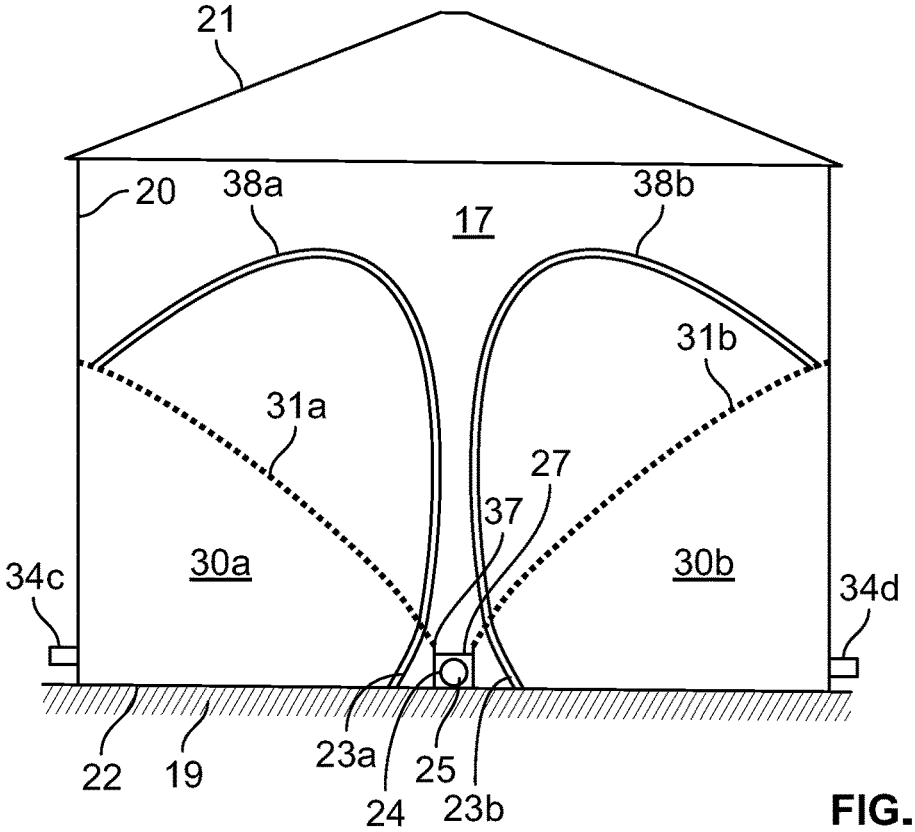
FIG. 9 is a side section view of the Grain Silo with both liners completely unloading.

FIGS. 7 and 8 show the second inflate liner 38*b* moving through the grain 39*b* unloading process as the first inflate liner 38*a* continues to inflate. As shown, the first inflate liner 38*a* may remain inflated to provide a wall or backstop so that grain 39*b* does not spill over into liner compartment 30*a*. Liner Inflate blower 109 (not shown) may be made portable and equipped with a check valve, hose, pressure gauge and cam-lock fittings to enable the operator the ability to easily and quickly change from inflate compartments 30*a* and 30*b* via liner inflation ports 34*c* and 34*d* respectively. FIG. 9 shows both inflate liners 38*a* and 38*b* completely inflated after all grain has been emptied from grain silo via auger 26. Other unloading methods may include the use of belt, chain, air slides and pneumatic conveying equipment may be used in place of auger 26.

Figure 10:
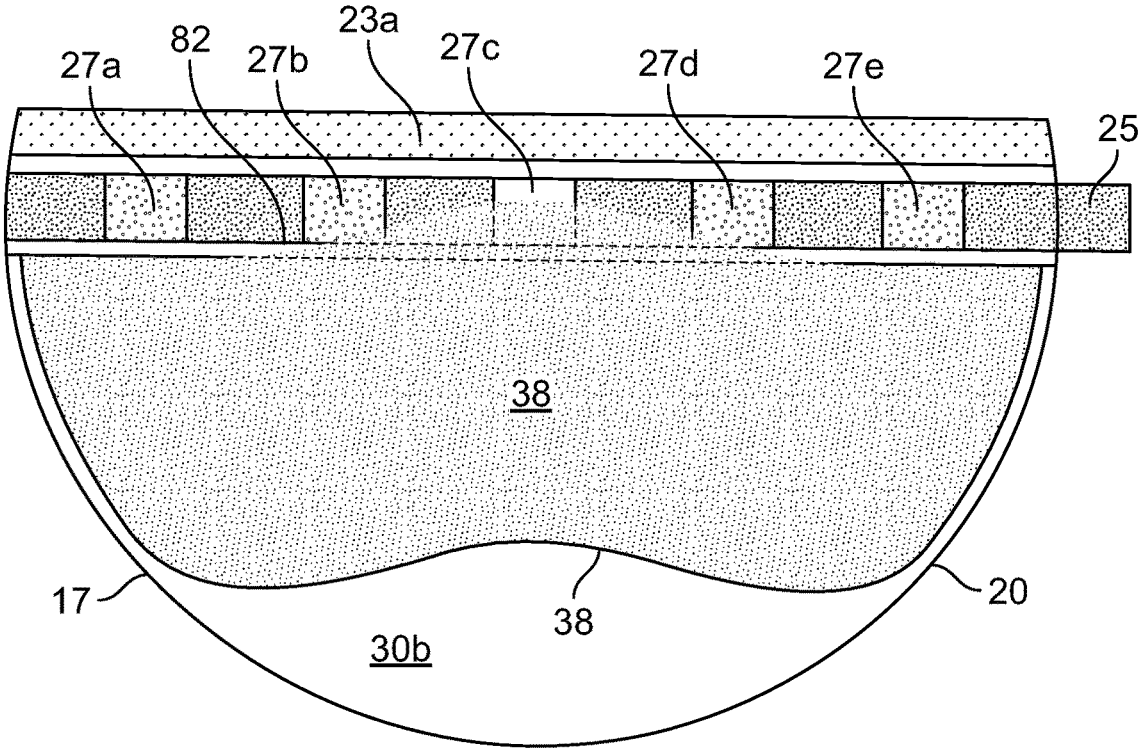
FIG. 10 is a top section view of the Silo showing a stage of unloading dry material.

FIG. 10 shows a top view of the liner inflate compartment 30*b* during the initial unloading stage, wherein the center well 27*c* is opened to begin the silo unloading operation. To provide a safe and balanced unloading procedure, the center well 27*c* is opened while other side wells 27*a*, 27*b*, 27*d* and 27*e* remain closed. As the silo unloading procedure continues from a gravity discharge to an assisted discharge with inflate liner 38, center well 27*c* remains open while other wells 27*a*, 27*b*, 27*d* and 27*e* remain closed causing inflate liner to move inward from silo wall opposite well 27*c*. Moving inflate liner 38 across from well 27*c* first ensures the load of grain 39 is balanced evenly and centered on inflate liner 38. Maintaining equal loading and no loading conditions on inflate liner 38 is important so that no uneven pressures and possible unloading problems occurs. To provide safe and efficient unloading, the inflate liner should move as an inflated wall extending parallel with conveyor trough 23*a*. Once inflate liner 38 moves inward toward the conveyor trough 23*a* and establishes an inflated wall position, wells 27*a*, 27*b*, 27*c*, 27*d* and 27*e* are opened and closed accordingly to keep inflate liner 38 moving as an inflated wall rather than having certain parts balloon outward, which will cause a load imbalance of grain 39 on the inflate liner 38. These load imbalances result in concentrated loads and stresses that could possibly damage the grain silo 17 and the inflate liner 38.

Along with inflating the first inflate liner 38*a* and the second inflate liner 38*b*, the liner system provides a liner return system to return a fully inflated liner 38 back to its original position against the silo wall 20 and silo floor 22 during a deflation cycle. FIGS. 11-14 illustrate one embodiment of the liner return system according to present invention. The liner return system includes a liner return weight 43W attached to liner return cord 41 via liner return pulley 42*a*. By locating the first liner return anchor 43*a* under clamp bar 31 a few feet away from liner return pulley 42*b*, liner return weight 43W is able to move up and down freely without rubbing against the silo wall 20. End of liner return cord 41 is connected to the inflate liner 38 by a second liner return anchor 43*b*. Liner return weight 43W should have a sufficient weight and size to provide enough pulling force to pull the liner while it is airborne, thereby returning the liner to the silo wall 20 after the inflation cycle is completed. Liner return weight 43W can be a piece of steel or a bag filled with sand. Liner return anchor 43*b* can be 12" in diameter or larger and made in different shapes and sizes. The liner return cord 41 may consist of a bungee cord, cable or a rope.

Figure 11:
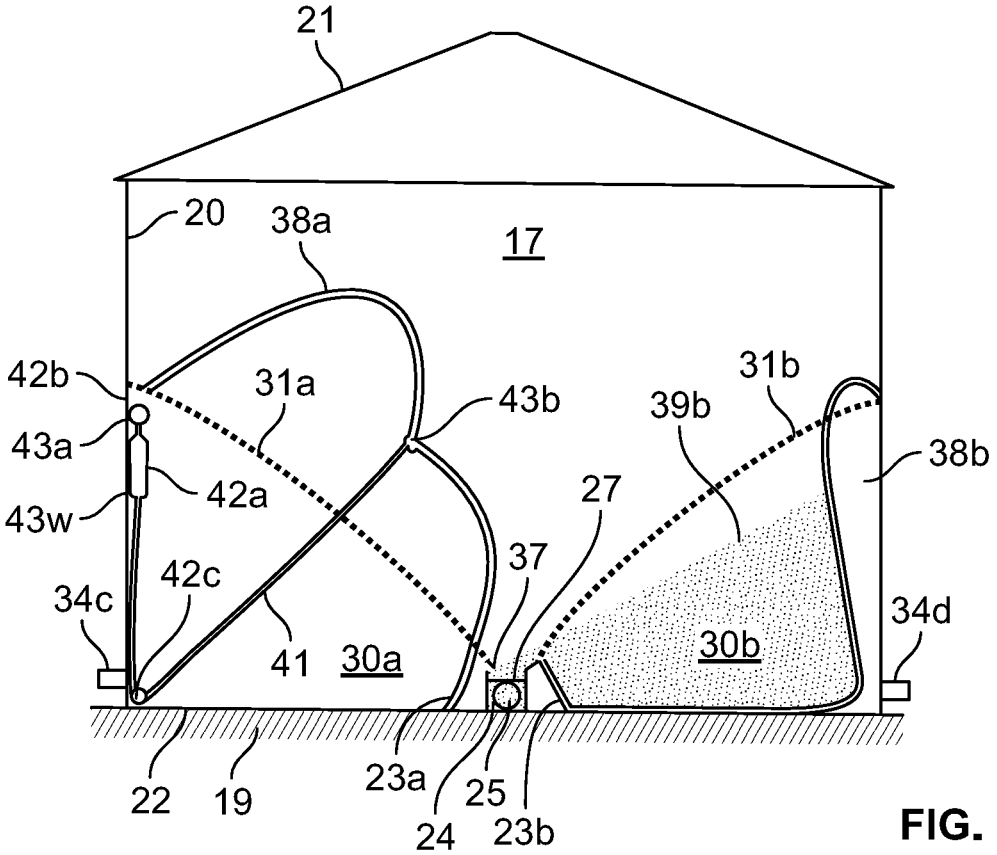
FIG. 11 is a side section view of the Grain Silo showing the return line system.

FIG. 11 shows a side view of the grain silo 17 during the initial stage of the inflate liner 38*a* returning back toward silo wall 20 via liner return cord 41. The liner return cord 41 is routed between the first liner return anchor 43*a* and the second liner return anchor 43*b* by liner return pulleys 42*a* that is attached to liner return weight 43W and fixed liner return pulley 42*c*. Liner return pulley 42*c* not only pulls the inflate liner 38*a* back to silo wall 20 but also centers it on the silo floor. One or more liner restraint cords may be used if required.

Furthermore, as soon as grain 39*a* (not shown) is completely emptied from liner air compartment 30*a* in grain silo 17 using the first inflate liner 38*a*, the second inflate liner 38*b* can begin to immediately empty grain 39*b* from liner air compartment 30*b* because the inflate liner 38*a* is immediately pulled back and away from valve 27 and conveyor housing 23*a*. Return of the inflate liner 38*a* is activated by the removal of a blower hose with a one way check valve, thereby disconnecting the inflate liner 38*a* from the inflate blower. Once the blower hose 126 is removed, air may flow out of air outlet (not shown) from liner air compartment 30*a*. As a result, the first inflate liner 38*a* is able to float on a cushion of air while the liner restraint cord 41 pulls the first inflate liner 38*a* back to silo wall 20. This immediate action of liner restraint cord 41 prevents an interruption in the silo unloading process because inflate liner 39*b* can be operated very quickly.

Figure 12:
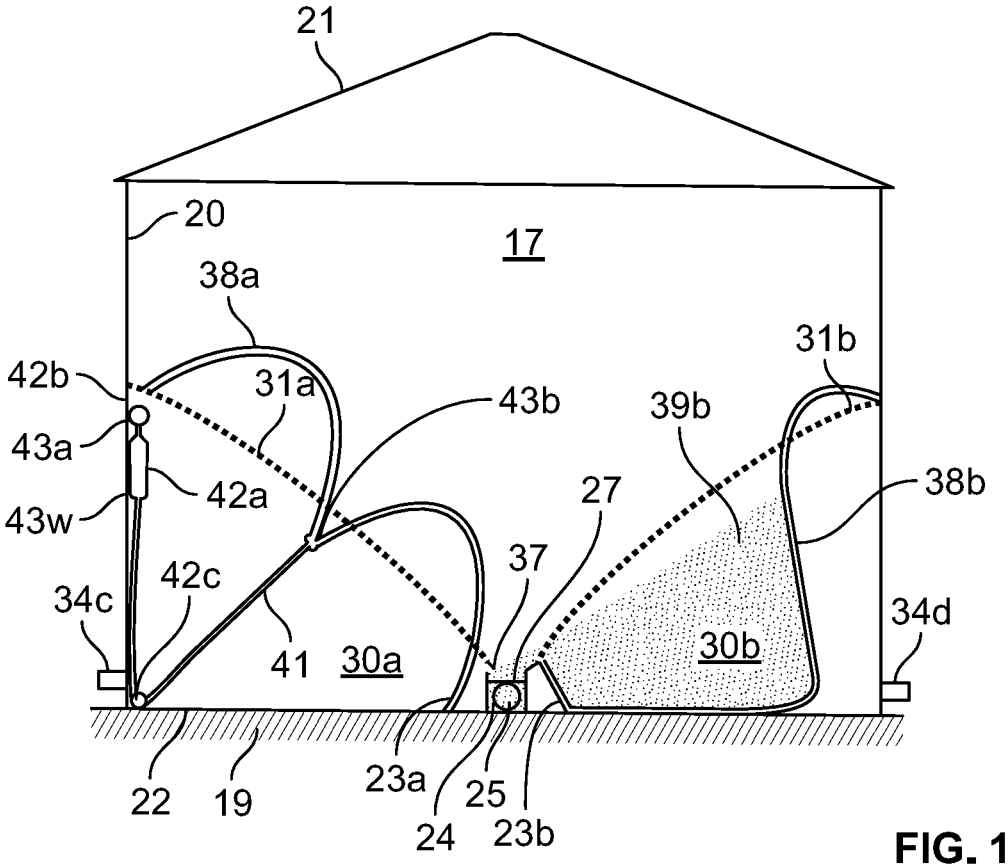
FIG. 12 is a side section view of the Grain Silo showing the return line system.

As shown in FIG. 12, the first inflate liner 38*a* is pulled about half way back to silo wall 20 by the liner restraint cord 41. The liner restraint cord 41, liner return anchors 43*a* and 43*b*, liner return pulleys 42*a*, 42*b* and 43*c* and the liner return weight 43W are concealed between silo wall 20, silo floor 22 and inflate liner 38*a*. Liner return anchor 43*b* may be placed on the exterior side of inflate liner and made of a size and shape that can support the load of liner return weight 43W during the inflation and deflation cycles of inflate liner 38*a*. As the first inflate liner 38*a* moves back toward the silo wall 20, the liner return weight 43W moves downward along inside of silo wall 20.

Figure 13:
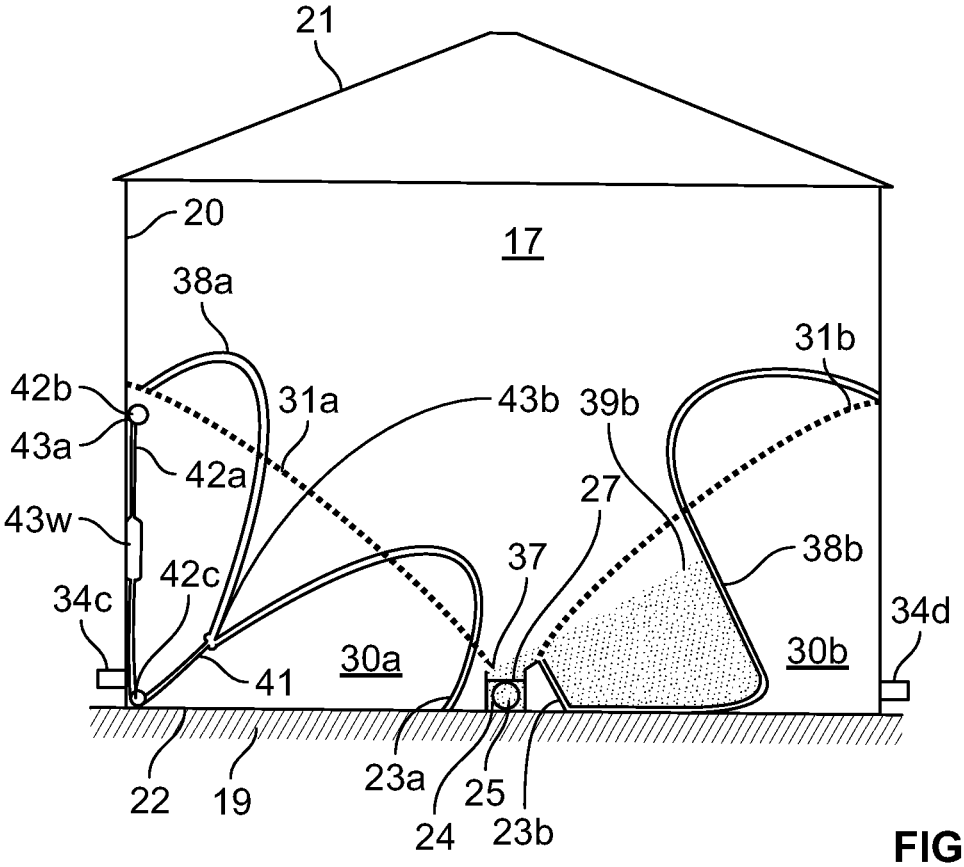
FIG. 13 is a side section view of the Grain Silo showing the return line system.
Figure 14:
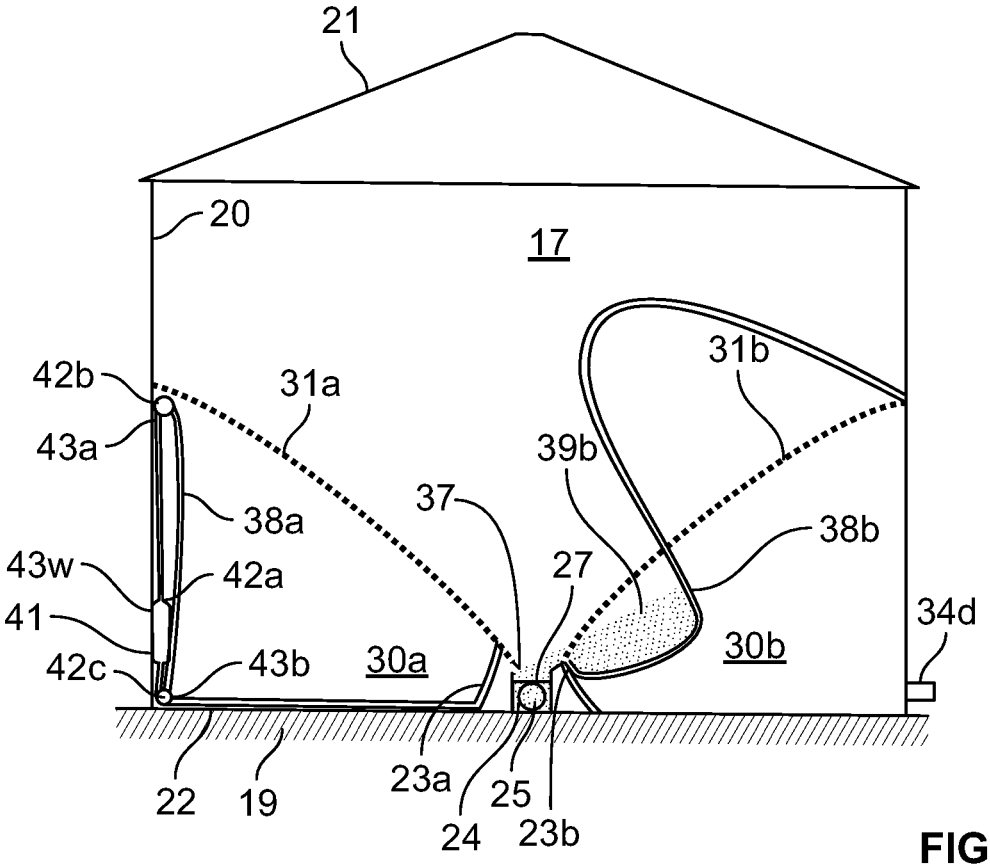
FIG. 14 is a side section view of the Grain Silo showing the return line system.

FIGS. 13 and 14 show the final stages of the deflation cycle of inflate liner 38*a*. As counterweight 43W moves downward, the first inflate liner 38*a* continues to be pulled back to the silo wall 20. In large silos having a diameter of approximately 36' in diameter, the weight of inflate liner 38*a* may be 250 pounds or more, and once it falls to silo floor 22 directly after the inflation cycle, the inflate liner 38 will fold and pile up on itself on and near the conveyor housing 23*a* without the help of liner restraint cord 41. In addition to forming a heavy, tangled and pile of fabric, fabric, a vacuum may form under the inflate liner 38, making it even more difficult to move the inflate liner 38 back into position for silo reloading. Liner Return weight 43W needs to be heavy enough to allow liner restraint cord 41 to pull back the first inflate liner 38*a* while a cushion of air remains for the first inflate liner 38*a* to be supported on during the deflation cycle. The liner restraint cord 41 system eliminates a lot of strenuous labor for returning the inflate liner 38*a* to its proper position on silo floor 22.

As shown in FIG. 14, the first inflate liner 38*a* is pulled back completely to silo wall 20 as the liner return weight 43W is at or near the level of silo floor 22. During the inflation cycle, as the inflate liner 38*a* moves away from silo wall 22, the liner restraint cord 41 is pulled by the inflate liner 38 causing liner return weight 43W to rise. Second liner return anchor 43*b* needs to have sufficient surface area and a proper shape to spread the load produced by the liner return weight 43W so that no significant stress or damage occurs to the inflate liner 38*a* during the inflation cycle. As the inflate liner 38*a* is pulled back to silo wall 22, the second inflate liner 38*b* and the conveyor auger 26 (not shown) are able to function without delay or other interruptions. Consequently, the liner return system reduces the need for bin entry by workers.

Figure 15:
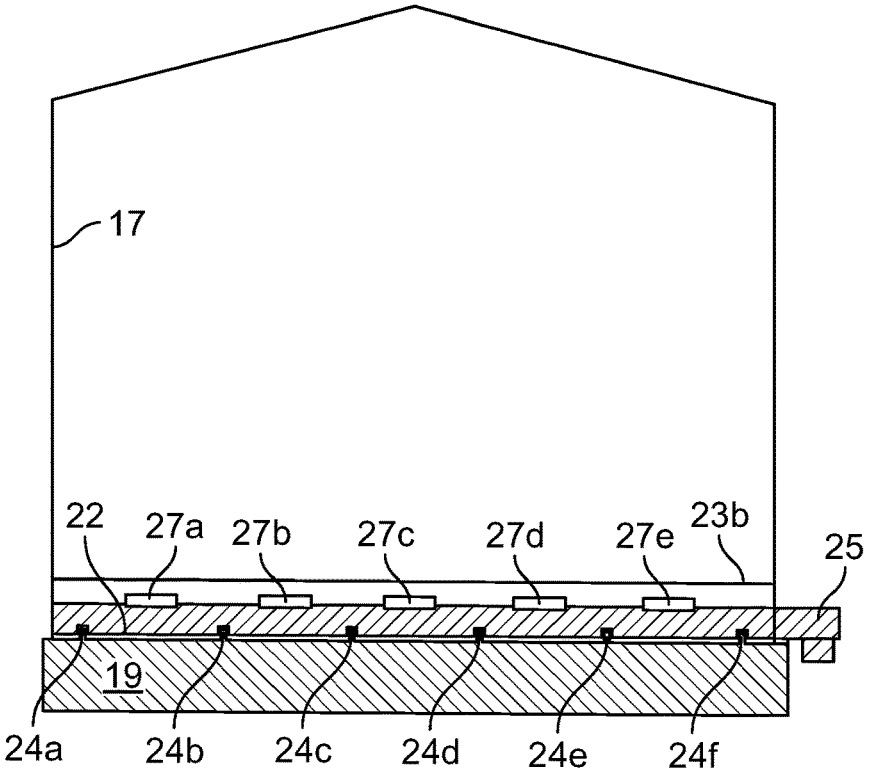
FIG. 15 is a side view of the Conveyor Assembly according to one embodiment of the present invention.
Figure 24:
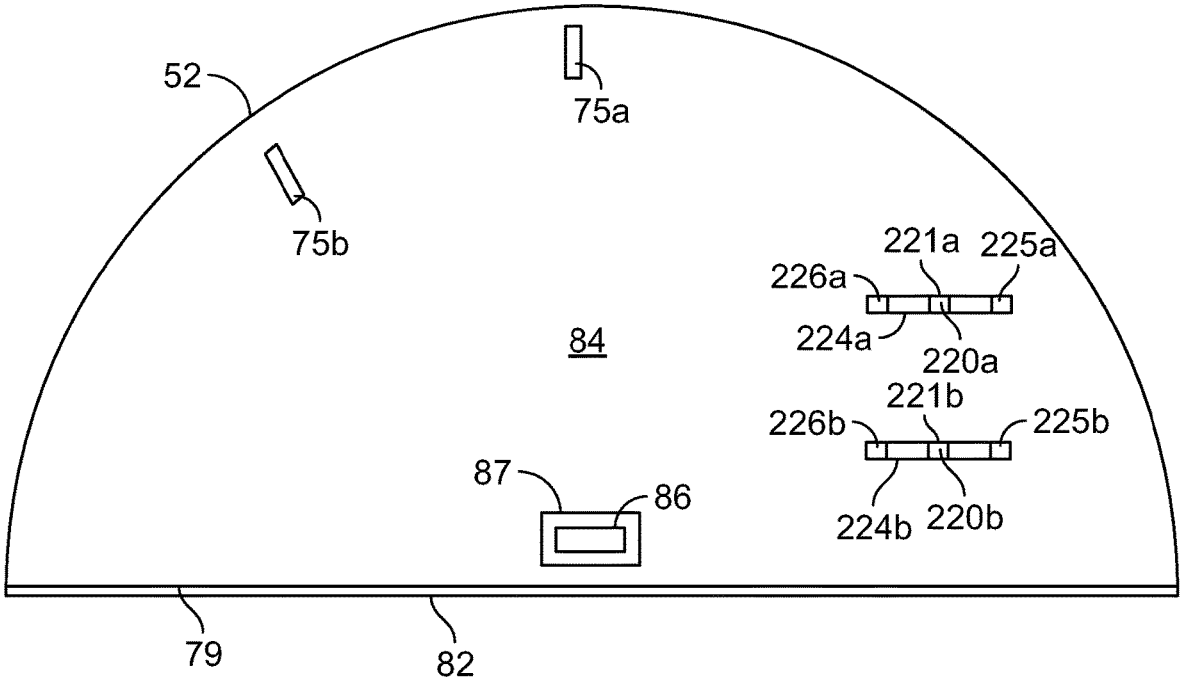
FIG. 24 is a top view of the Inflate Liner Floor according to one embodiment of the present invention.

FIG. 15 shows an embodiment of the auger 28 incorporated with the liner system according to the present invention. As shown in FIG. 24, auger 26 is secured to conveyor mounts 24*a* to 24*f*, which are connected to foundation 19. Conveyor tube 25 is the housing for the auger 26 and equipped with valves 27*a* to 27*e*. Valves 27*a* to 27*e* are typically controlled (open and closed) on an independent basis, and it is necessary that only center valve 27*c* is opened first and used until gravity flow of the grain 39 (not shown) ends. Once gravity flow of grain through center valve 27*c* ends, then valves 27*a*, 27*b*, 27*d* and 27*e* can be opened. It is important to note that in addition to emptying grain silo 17, inflate liners 38*a* and 38*b* (not shown) may also be used to overcome bridging and rat-holing in grain silo 17 before gravity discharge is completed. Here, in this case, the the inflate liners 38*a* and 38*b* will push forward directly toward center valve 27*c*. Valve 27*c* is the area within grain silo 17 where grain 39 (not shown) is moving and where a possible void may occur.

Figure 16:
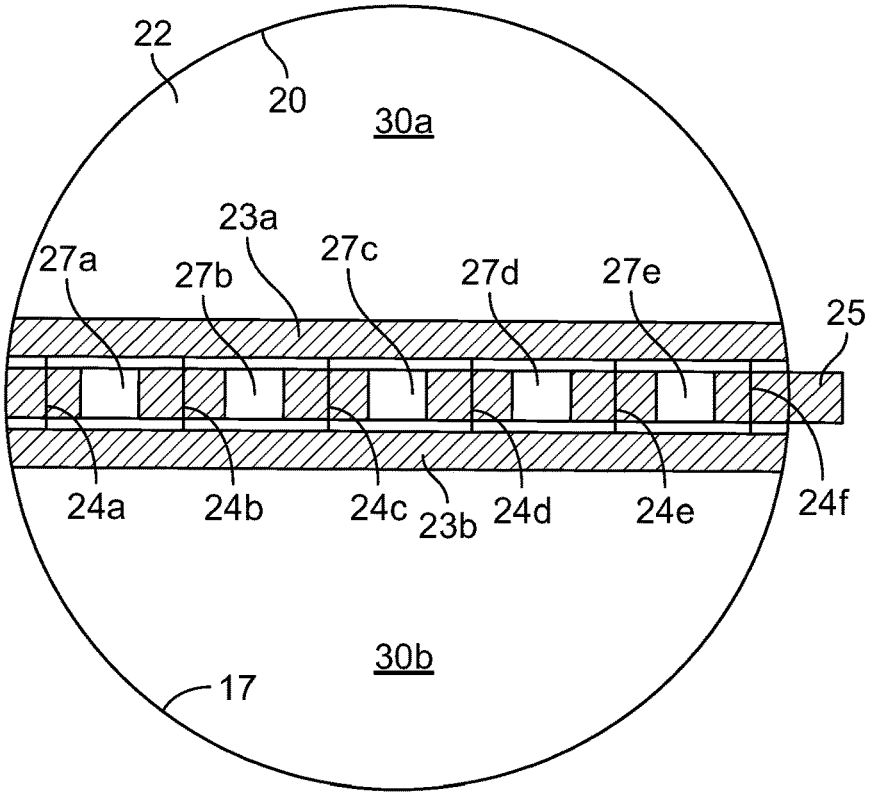
FIG. 16 is a top view of the Conveyor Assembly according to one embodiment of the present invention.

FIG. 16 shows a top section view of grain silo 17 with the conveyor tube 25 secured in place between conveyor housings 23*a* and 23*b*. Preferably, the conveyor tube 25 is equipped with an odd number of valves (27) so that a "center" opening will be used during the unloading process. However, in some cases, especially if there are a large number of valves 27 (and openings used), there may be a plurality of "center" valves used. Under normal installation conditions, inflate liners 38*a* and 38*b* may be partially installed in grain silo 17 before the conveyor housings 23*a* and 23*b*, the conveyor tube 25, the auger 26, the valves 27*a* to 27*e* and the conveyor support mounts 24*a* to 24*f* are secured to each other. For new installations, one or more of inflate liners 38*a* and 38*b*, silo wall clamp bars assemblies, conveyor housings 23*a* and 23*b*, conveyor tube 25, auger 26, conveyor support mounts and other components may be placed and stored on foundation before or during the erection of grain silo 17. For existing silo installations that are to be retrofitted with an embodiment according to the present invention, each silo may be equipped with a silo door 91 (not shown) and man-way openings 32*a* and 32*b* (not shown).

Figure 17:
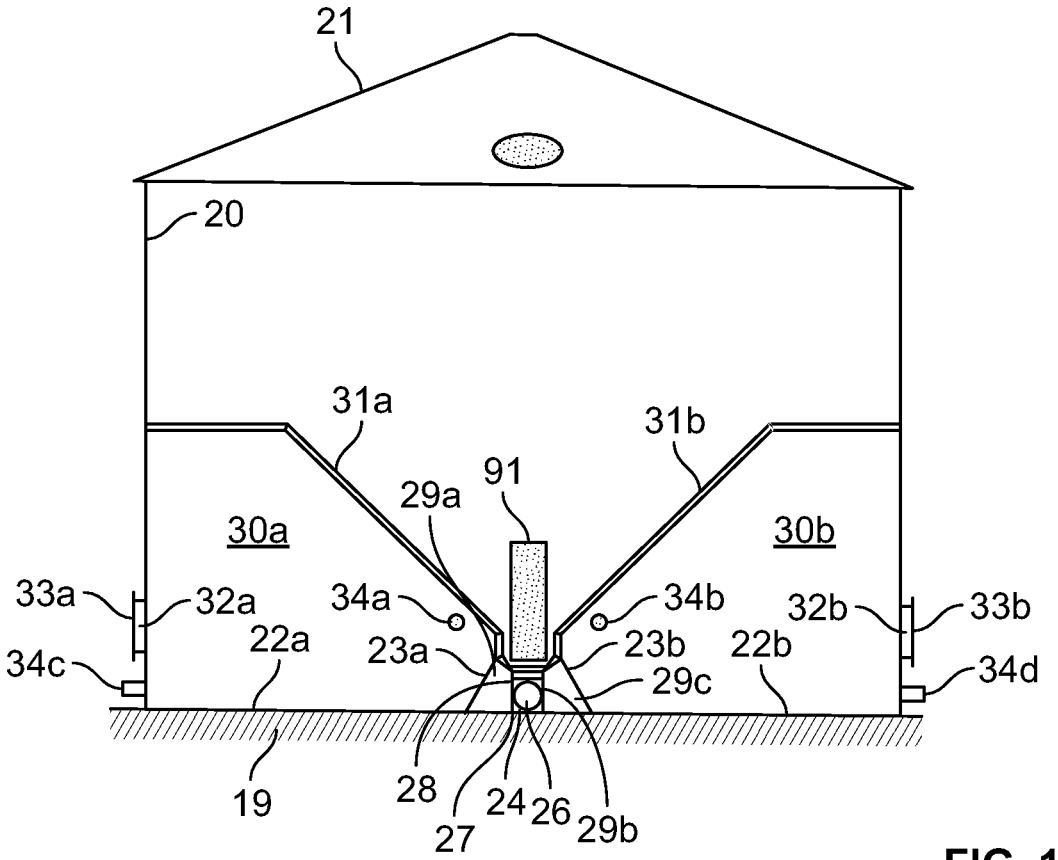
FIG. 17 is a side section view of the Air Compartments according to one embodiment of the present invention.

FIG. 17 shows an end section view of the conveyor aeration assembly 37. The assembly includes air tight and leak proof liner air compartments 30*a* and 30*b* defined by silo wall clamp bars assemblies 31*a* and 31*b*, conveyor housings 23*a* and 23*b* silo wall sections 20*a* and 20*b* and silo floor sections 22*a* and 22*b*, all as leak proof boundaries. To ensure liner air compartments remain air tight and leak proof, a variety of caulks, coatings, spray foams and gaskets are used in all the intersections between components and the structures that they are secured to in the grain silo 17. As an added measure, one or more flexible liner structures (not shown) such as a sheet of polyethylene film may be laid across silo floor sections 22*a* and 22*b*, as well as silo wall sections 20*a* and 20*b*. To help with the installation, testing, set up, pressure tests, trouble shooting procedures and repair functions, man-way openings 32*a* and 32*b* are provided silo walls 20*a* and 20*b*, thereby allowing service people access to the inside of the liner air compartments, as required. Liner inflation ports 34*a* and 34*b* are located near door 91 so that a liner inflate blower 109 may be operated via a hand held remote switch by the operator while monitoring the grain silo unloading process. Liner inflation ports 34*c* and 34*d* may also be used for inflation but are primarily used for deflation when man-way cover 33*a* and 33*b* may need to be removed. As with the other components within liner air inflate compartments, man-way cover may be equipped with gaskets, caulk or other sealing products to ensure an air tight fit.

Figure 18:
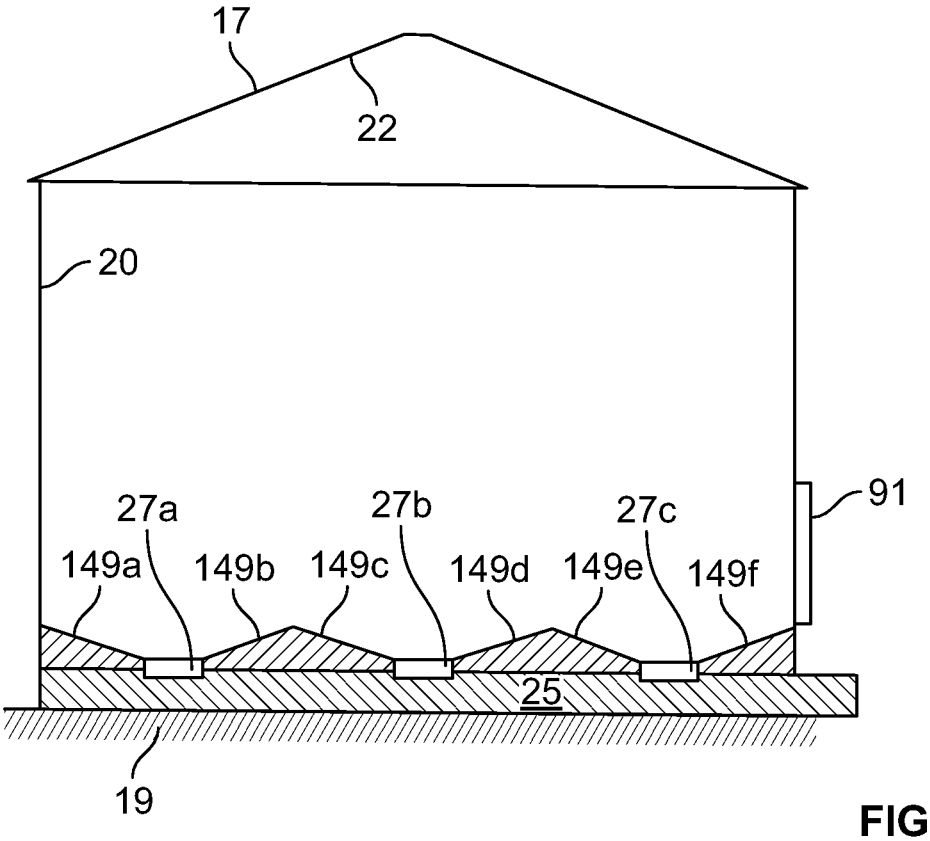
FIG. 18 is a side view of the Conveyor Assembly according to one embodiment of the present invention.

FIG. 18 illustrates an embodiment of the aeration conveyor assembly 37 having transition hoppers 149*a*, 149*b*, 149*c*, 149*d* and 149*e* located between valves 27*a*, 27*b* and 27*c*. As shown, valves 27*a*, 27*b* and 27*c* are located directly on conveyor 25 that provide a low point of entry. As a result, the inflate liners 38*a* and 38*b* (not shown) operate at the lowest air pressure required compared to the air pressure that would be required if the top most elevation of transition hoppers 149*a* to 149*f* were at the point of entry for the grain to enter the conveyor tube 25. In operation, grain 39 (not shown) flows to valves 27*a* to 27*c* during the unloading procedure. It is only at the end of the inflation cycle that the grain remaining behind transition hoppers 149*a* to 149*f* is lifted up above the hoppers 149*a* to 149*f*, where the grain then flows down trough of transition hoppers 149*a* to 149*f* and flows into valves 27*a* to 27*c*, respectively. Accordingly, grain that rests on on transition hopper 149*a* slides into valve 27*a* at the end of the unloading cycle. Furthermore, grain grain material left on transition hopper 149*a* will flow into valve 27*a*. Grain left on transition hoppers 149*c* and 149*d* will flow in valve 27*b*, while grain left on transition hoppers 149*e* and 149*f* will flow into valve 27*c*. Vibrators may be used in conjunction with transition hoppers 149*a* to 149*e* 149*e* to help induce material flow in addition to gravity.

Figure 19:
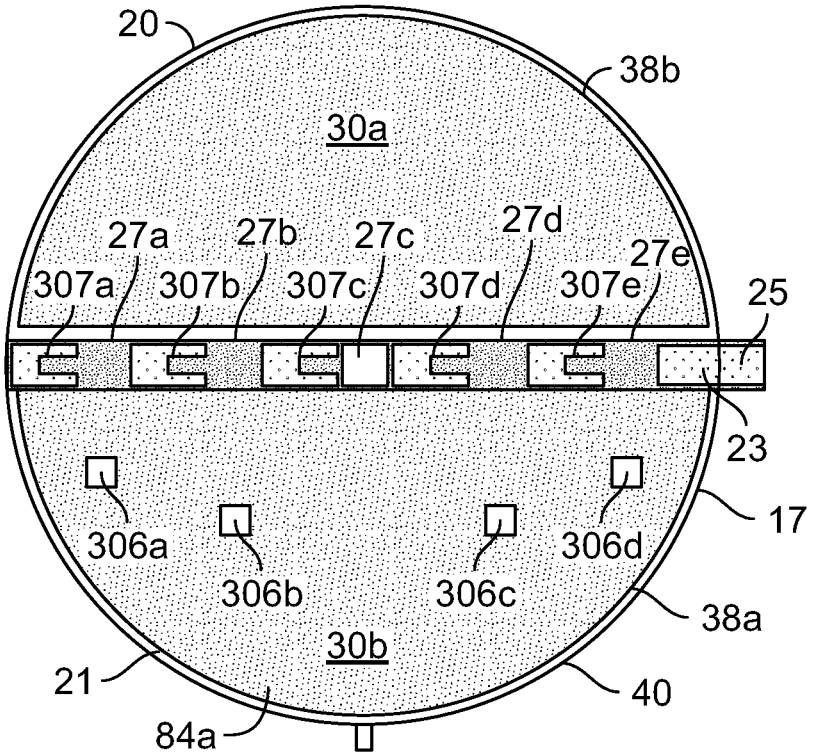
FIG. 19 is a top view of the Grain Silo prior to unloading.

FIGS. 19-22 show an embodiment of the conveyor assembly 37 implementing a plurality of switches 306*a-e* to activate the valves 27*a-e* of the auger 26. The plurality of switches 306*a-e* are employed to maintain the proper balance of load on the liner 38. In FIG. 19, prior to using the first inflate liner 38*a* for unloading after gravity discharge ends, center valve 27*c* is opened, while side valves 27*a*, 27*b*, 27*d* and 27*e* remain closed. The valve switches 306*a* to 306*d* are mounted on silo floor 21 (typically cement) and under inflate liner floor 84*a*. When a load of grain is resting on silo liner floor 84*a*, its weight will push switches 306*a* to 306*d* to a closed position. Once the inflate liner 84*a* moves past the valve switches 306*a* to 306*d* toward the conveyor housing 23, the respective switch 306 will then change positions to activate valve actuators 307*a* to 307*e*. Any type of switches may be used and in any position. Valve actuators may be pneumatic cylinders, hydraulic cylinders, linear actuators or other types of motorized devices.

Figure 20:
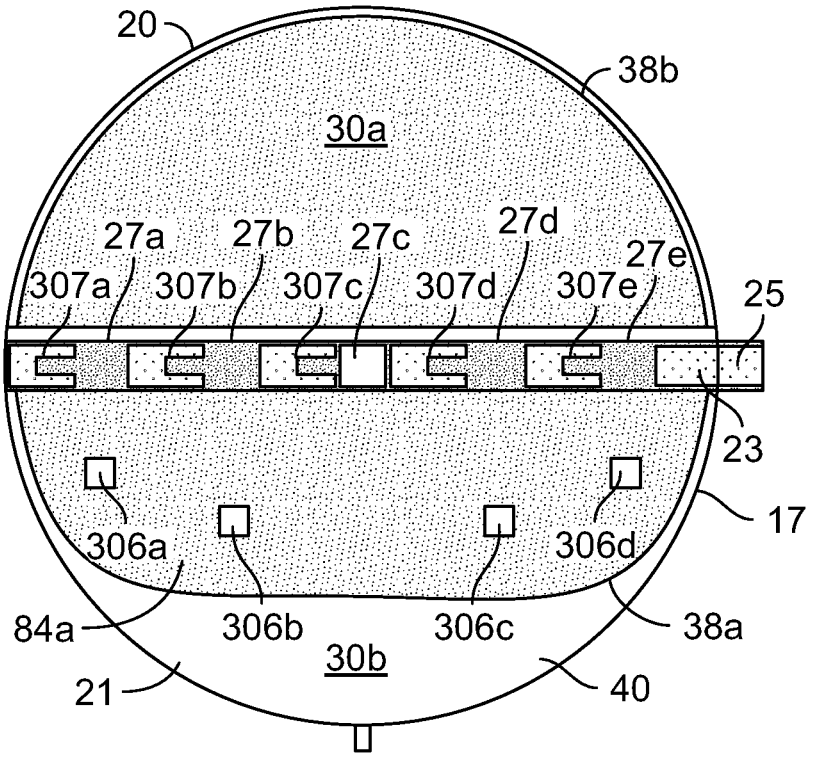
FIG. 20 is a top view of the Grain Silo starting to unload.

As shown in FIG. 20, the inflation cycle of the first inflate liner 38*a* begins with the first inflate liner 38*a* moving away from the silo wall 20. With a load of grain on silo floor 21 and inflate liner floor 84*a*, valve switches 306*a* to 306*d* remain in an unchanged position since the inflate liner 38*a* began inflating. The inflate liner 38*a* is moving in parallel with conveyor housing 23, as a relatively straight wall that is even and balanced.

Figure 21:
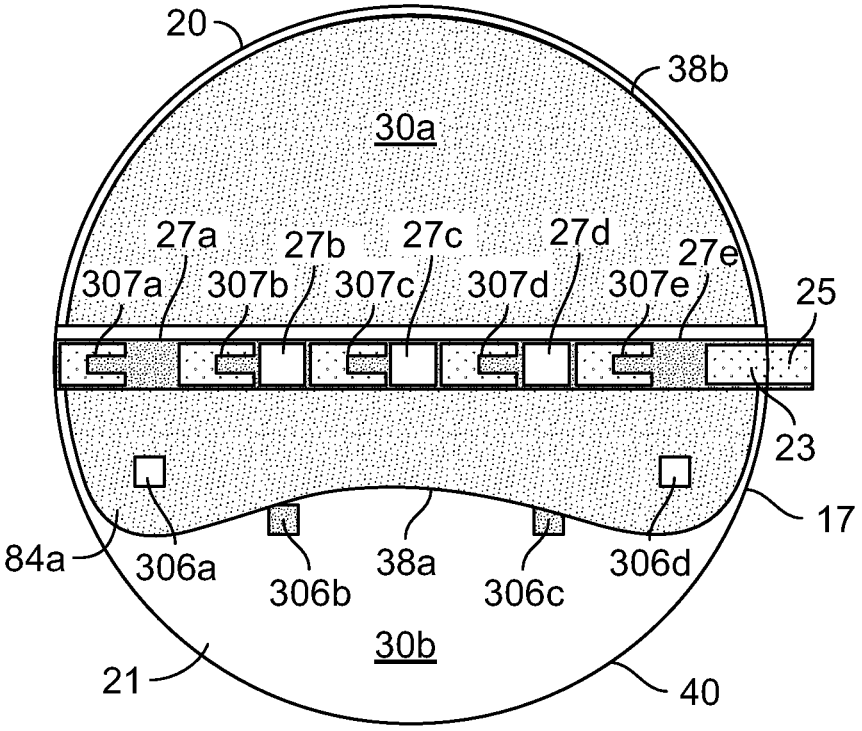
FIG. 21 is a top view of the Grain Silo unloading.

In FIG. 21, the inflate liner 38*a* continues to push grain toward and into valve. The center part 38*a*C of inflate liner 38*a* begins to move ahead of the sides of inflate liner 38*a* and lose its shape as a relatively straight wall. To counteract the change in shape and to keep inflate liner 38*a* 38*a* with a balanced load on it, the valve actuators 307*b* and 307*d* are actuated just as the inflate liner floor 84*a* moves past the valve switches 306*b* and 306*c* on the silo floor 21. Accordingly, valves 27*b* and 27*d* are respectively opened.

Figure 22:
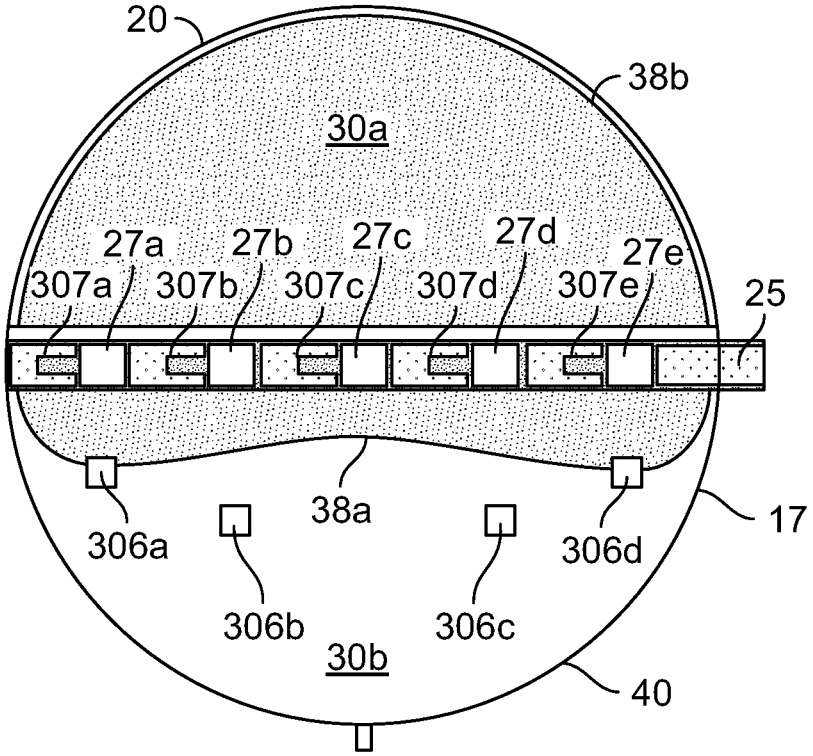
FIG. 22 is a top view of the Grain Silo unloading.

In FIG. 22, switches 306*a* and 306*e* are activated, thereby triggering valve actuators 307*a* and 307*e*. Ultimately, valves 27*a* and 27*e* are set to open. With valves 27*a* to 27*e* open, inflate liner 38*a* begins to straighten out and forms an inflated wall that pushes the remaining grain to the auger 26 (not shown) confined in the conveyor tube 25. If desired, valve 27*c* may be closed slightly, or completely, as well as valves 27*b* and or 27*d*, to cause inflate liner 38*a* to from more of a straight wall form.

According to one embodiment of the present invention, the liner 38 is constructed out of a polyester fabric that is woven in a rip-stop scrim pattern. The fabric of the liner 38 is further coated with a PVC resin, which allows the liner to protect the grain from moisture. When secured in the grain silo, the inflate liner 38 is divided into an inflate liner wall 85 aligned with the silo wall 20 and an inflate liner floor 84 aligned with the silo floor 22. A liner floor to wall joint 52 is formed between the inflate liner wall 85 and the inflate liner floor 84.

Figure 23:
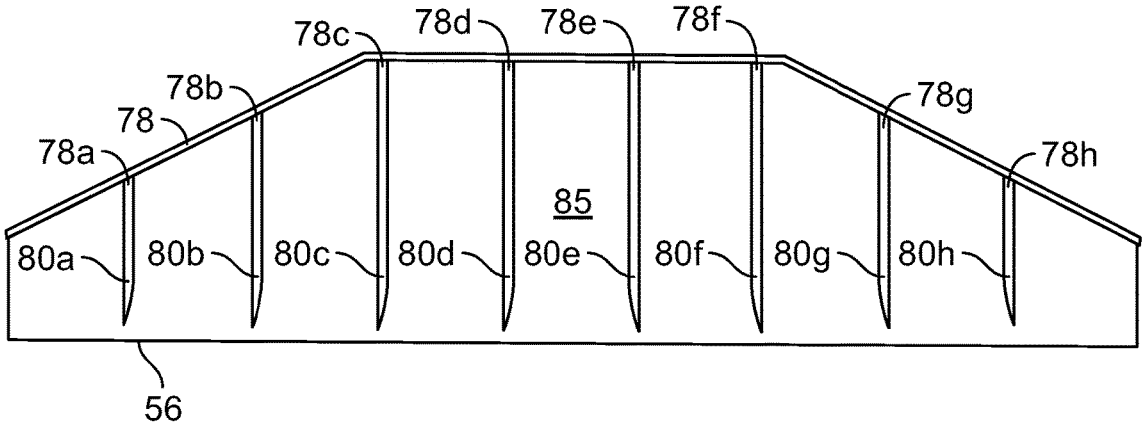
FIG. 23 is a front view of the Inflate Liner Wall according to one embodiment of the present invention.

FIG. 23 shows a front view of the inflate liner wall 85 with inflate liner pleats 78*a* to 78*h* folded and secured to top edge of inflate liner 38. The linear reserves 80*a* to 80*h* (each having an average width of 12") are formed by inflate liner pleats 78*a* to 78*h*, thereby allowing inflate liner panel 85 to expand easily against silo wall 20 without any tension or stress. The number of inflate liner pleat(s) 78 used in inflate liner wall 85 and or inflate liner floor 84 (not shown) may vary according to the size of each grain silo 17. As a result, the liner 38 is able to expand and push the grain toward the central trough at low air pressure, such as between 0.15 PSI and 2 PSI.

Due to the large size and weight of the inflate liner 38*a*, it is difficult to have inflate liner 38 fit like a glove inside grain silo 39. Accordingly, the inflate liner 38 must be oversized so that the inflate liner 38 is fully supported. Folded and fastened behind clamp bar 56, inflate liner pleat 78 provides the linear liner reserve 80 "slack," which eliminates stress along the inflate liner wall 85 and inflate liner floor 84 when the grain silo 17 is refilled with grain 39.

According to one illustrated embodiment, FIG. 24 shows a top section view of inflate liner floor 84 equipped with pull strap 75*a* on its top surface (against grain 39) and pull strap 75*b* attached to the bottom of the inflate liner floor 84 (against silo floor) to enable workers to grab and then move inflate liner 38. A filter fabric vent 86 is secured to inflate liner floor 84 close to the conveyor edge 82 and roped edge 79 at the approximate center. A section of inflate liner floor 84 is cut out and replaced with filter fabric vent 86. Placed over the top of filter fabric vent 86 is vent cover 87, which is made of inflate panel PVC coated fabric that is non-breathable. Vent cover 87 is approximately 25% to 50% larger than filter fabric vent 86 and is loosely attached at its corners to inflate floor 84 over filter fabric vent 86. Vent cover 87 may or may not be with filter fabric vent 86. Because filter fabric vent 86 is located next to conveyor edge 82 of inflate floor 84, the portion of the liner floor closest to the conveyor edge 82 will be the last section of inflate liner floor 84 to lift up and become vertical at the end of the inflation cycle.

With the load of grain now removed over vent cover 87, filter fabric vent 86 can breathe, thereby allowing the pressurized air within liner air compartment to exist at a lower pressure. Filter fabric vent 86 may have a pressure resistance from approximately 0.01 PSI to 0.15 PSI so that if inflate blower 109 is left on too long, the air pressure inside liner air compartment cannot build past 0.01 to 0.15 PSI, which is considered a low pressure that will not cause any damage to inflate liner 38 or other components. However, if the air pressure were to keep building up to the inflate blower maximum pressure rating of about 3 PSI, certain damage would occur to grain silo 17 and inflate liner 38. Other advantages of using filter fabric vent 86 is less likelihood of failure, controlling grain from entering the liner air compartment 30, and function at the very end of the unloading cycle.

During the manufacturing process to make a complete inflate liner floor 84, inflate liner wall joint 52 in FIG. 24 will be sealed to inflate liner wall joint 52 in FIG. 23. Filter fabric vent vent 86 can be placed on the section of inflate liner floor 84, close to conveyor edge 82, which will be the last part of inflate liner floor 84 to lift up and become vertical next to conveyor edge 82 at the end of the unloading cycle. Inflate liner floor 84 will lift up and empty grain according to the sequence of opening valve(s) 27.

The inflate liner floor 84 further includes aeration tube flexible straps 224*a* and 224*b* attached to inflate liner floor 84 through bolts 220*a* and 220*b* and washers 221*a* and 221*b*. Flexible straps 224*a* and 224*b* are equipped with hook-and-loop fastener strips 226*a* and 226*b* and hook-and-loop fastener strips 225*a* and 225*b*, respectively, so that flexible straps 224*a* and 224*b* can be wrapped around aeration tubing (not shown), thereby securing the aeration tubes on the inflate liner floor 84 during the inflation and deflation cycles of inflate liner 38. This type of attachment can be used in a hopper, flat-bottom or sidewall area of inflate liner 38.

Figure 25:
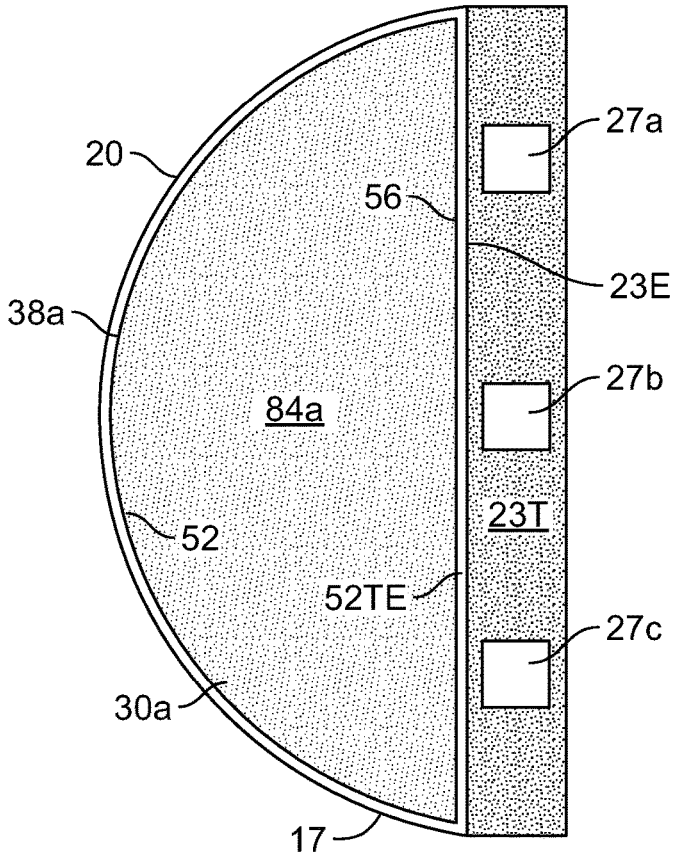
FIG. 25 is a sectional top view of the liner floor and trough according to one embodiment of the present invention.

FIG. 25 shows a partial top section view of silo 17 according to an embodiment of the present invention. The liner air compartment 30*a* is defined between the silo wall 20 and the conveyor trough deck 23T, enclosed by the installation of the inflate liner 38*a*. The edge of the liner 38*a* defined by the liner floor to wall joint 52 is approximately 1.5 times longer than the inflate liner trough edge 52TE. As a result, this ratio between the length of the liner floor to wall joint 52 and the length of the inflate liner trough edge 52TE allows the inflate liner 38*a* maintain a balance load without causing excessive folds and wrinkles during the inflation cycle. As the ratio of the inflate liner trough edge 52TE is reduced in comparison with the length of inflate liner floor to wall joint 52, excessive wrinkles and folds can occur to inflate liner floor 84*a* which can cause emptying problems, added stress on inflate liner 38*a*, higher inflation pressures (which may cause related damage), as well as cause problems in retracting inflate liner 38*a* properly to silo wall 20 during the deflation cycle in preparation for reloading silo 17.

Figure 26:
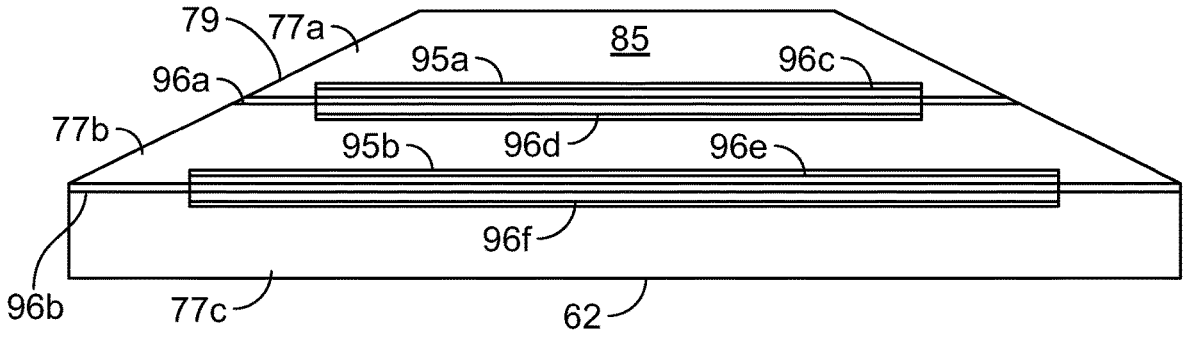
FIG. 26 is a top view of the Liner Wall according to one embodiment of the present invention.

FIG. 26 is a top view inflate liner wall 85 with inflate liner panels 77*a*, 77*b* and 77*c* fastened together via seals 96*a* and 96*b* respectively. To provide added strength to inflate liner wall, double seal panel 95*a* is sealed to inflate liner panel 77*a* and 77*b* by seals 96*c* and 96*d*. A double seal panel 95*b* is fastened to inflate liner panels 77*b* and 77*c* over seal 96*b* by seals 96*e* and 96*f* to provide added strength and support to seal 96*b*.

Figure 27:
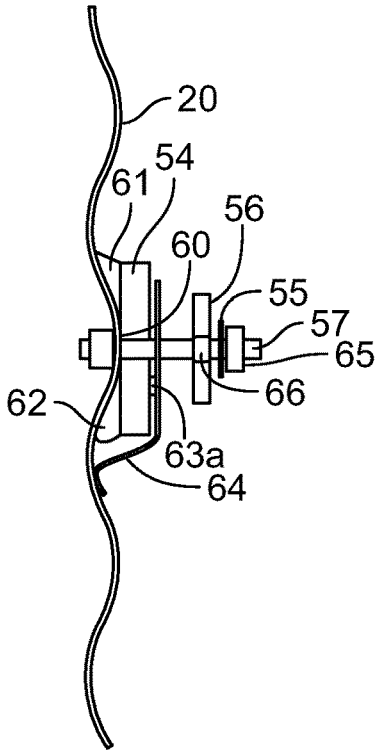
FIG. 27 is a section view of the Clamp Bar Assembly according to one embodiment of the present invention.

According to one embodiment of the present invention, a clamp bar assembly 31 is employed to mount the liner 38 against the silo wall 20, in which the clamp bar assembly 31 includes a clamp bar mounting plate 54 and a mount bolt stud 57. As shown in FIG. 27, a mount bolt stud 57*s* is fixed in a mounting plate hole 60 by a permanent thread locker, welding, or etc. Accordingly, a single threaded stud 57S can be used for securing clamp bar mounting plate 54 to silo wall 20, as well as using the same threaded stud 57S for securing clamp bar 56 in place during the inflate liner 38*a* (not shown) installation. A flexible shield 64 and a sealant 63 are applied between the clamp bar mounting plate 54 and clamp bar 56 to maintain an air-tight seal between the liner 38 and the silo wall 20, ultimately reducing the possibility of the clamp bar loosening or air leaks. The flexible shield 64 may be formed out of a flexible material, such as a polyethylene film. A gasket 61 and 62 is also implemented with the clamp bar assembly 31 to reinforce the seal between the liner 38 and the silo wall 20. Additionally, a clamp bar nut 65 and mount plate washer 55 may also be used to secure the mounting late 54.

Figure 28:
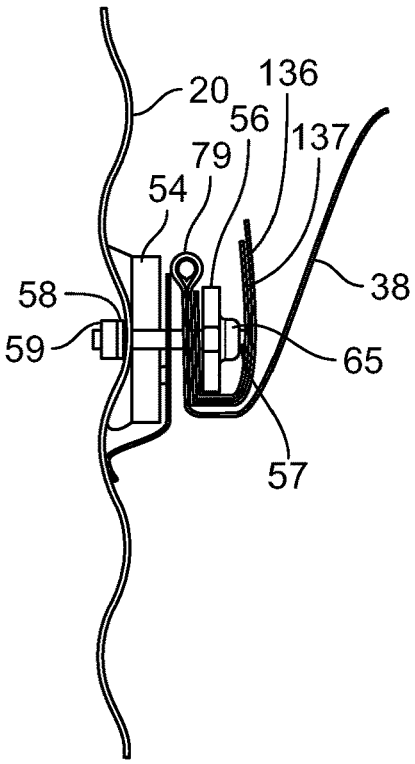
FIG. 28 is a section view of the Clamp Bar Assembly according to one embodiment of the present invention.

FIG. 28 further shows the clamp assembly 31 including an inflate flap 136 and a protective flap 137 to protect the liner from poking against the mounting plate bolt 57 and mounting plate nut 65. As shown FIG. 27, the inflate liner 38 with a roped edge 79 is clamped between the clamp bar mounting plate 54 and clamp bar 56. The inflate flap 136 extends below the clamp bar 56 56 by several inches to protect inflate liner 38 from possible damage during the inflation cycle. The protective flap 137 further protects the inflate liner 38, which may be damaged by bottom edge of clamp bar 56 as it inflates.

As shown in FIG. 28, the inflate liner 38 is inflated under pressure during the grain unloading cycle. Consequently, the inflate liner 38 has risen above and around clamp bar 56 and may be pressed against clamp bar bolt 57. The inflate liner flap 136 and protective flap 136 provide the liner 38 protection from rupture, tearing or other damage from clamp bar bolt 57, clamp bar bolt 65 and the bottom corners of clamp bar 56.

Figure 29:
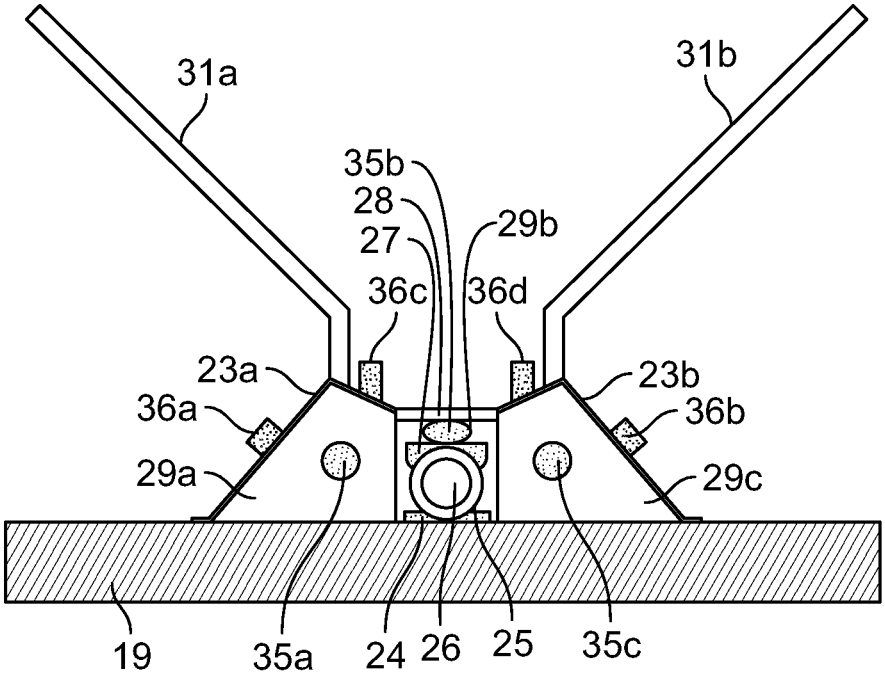
FIG. 29 is a section view of the Conveyor Housing and Aeration Deck according to one embodiment of the present invention.

In addition to using inflate liners 38*a* and 38*b* to unload grain from grain silo 17, the aeration conveyor assembly 37 of the liner system is also able to aerate grain stored in the silo. According to one embodiment of the present invention, FIG. 29 shows a section view of the silo having conveyor housings 23*a* and 23*b*, bottom ends of silo wall clamp bar assemblies 31*a* and 31*b*, auger housing 25 support mount(s) 25 and aeration deck 28. The conveyor housing 23*a* functions as an aeration housing conduit 29*a* that is pressurized with air by an aeration blower 108 connected to an aeration blower port 35*a* (not shown). Likewise, conveyor housing 23*b* functions as an aeration housing conduit 23*c* that is supplied with low pressure air by an aeration blower connected to aeration port 35*c*. The aeration blower port 35*b* is equipped between the outer walls of conveyor housings 23*a* and 23*b*, where a conveyor tube 25 is located in the aeration housing conduit 29*b*. If desired, aeration housing conduit can be connected together to act as a single source of aeration or kept separate from one another to provide three distinct source of low pressure air for aeration.

As shown in FIG. 29, the aeration housing conduits 29*a*, 29*b* and 29*c* remain separated from one another and provide three distinct sources of aeration from one or multiple aeration blowers. Aeration housing conduit 29*b* is supplied with low pressure air (½ PSI) via aeration blower port 35*b*, which enables grain directly above aeration deck 28 to be aerated in the grain silo. Preferably, the aeration deck 28 runs across the width of grain silo 17 and has openings that coincide with valve(s) 27. Aeration deck 28, which can be made of separate panels for easy removal and cleaning, can also be sloped into hopper shapes to help direct the flow of grain 39 into each valve 27 along conveyor housing 23.

While the aeration deck 28 and aeration housing conduit 29*b* supply aeration into the center area of grain silo 17, aeration housing conduit 29*a* is equipped with aeration exhausting couplings 36*a* and 36*c*, which may be attached to ancillary aeration fixtures that rest on the surface of inflate liner 38*a* (not shown). Similarly, aeration housing conduit 29*c* is equipped with aeration exhaust couplings 36*d* and 36*b*. Aeration exhaust couplings 36*a* and 36*b* are attached under inflate liner 38*a* and 38*b* and pass through inflate liner to fixture on top. Aeration exhaust couplings 36*c* and 36*d* connect to aeration fixtures on top of inflate liners 38*a* and 38*b* without passing through inflate liners 38*a* and 38*b*, providing a simpler operation and securing method. In the case of an inflate liner 38*a* or 38*b* (not shown) not falling back into position in the grain silo 17 due to the formation of folds and wrinkles, aeration exhausting couplings that have air tight valves (not shown) may be opened and operated via a blower to provide a burst of air under inflate liner floor 84 to free the liners 38*a* and 38*b* from clinging to silo floor by a vacuum condition. Any type of blower, whether aeration blower 108, liner inflate blower 109 or another type of blower may be used.

Figure 30:
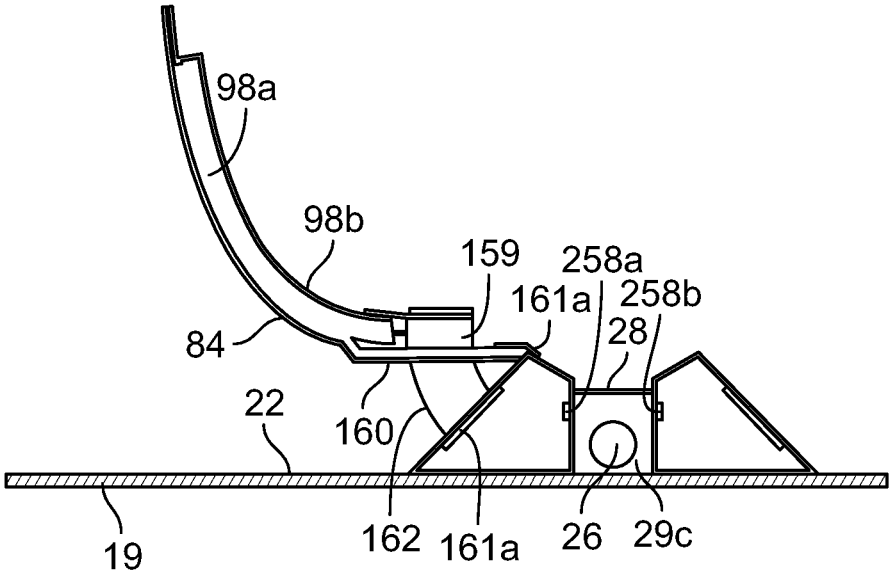
FIG. 30 is a section view of the Air Manifold for Aeration Tube according to one embodiment of the present invention.

The aeration tubes may also be equipped with a manifold assembly. As shown in FIG. 30, a liner manifold plate 160 pivots upward by hinge 161*a* as the inflate liner floor 84 raises off the silo floor 22 during the inflation cycle of grain unloading. To keep air from escaping within liner air compartment 30*a*, liner manifold conduit 162 is connected between liner manifold valve 161*a* and liner aeration manifold 159. Liner manifold conduit is typically made of a flexible material such as hose or a PVC coated fabric tube with reinforcements attached so that it remains open and cannot collapse. During the unloading process, aeration blower 108 (not shown) is turned off.

Figure 31:
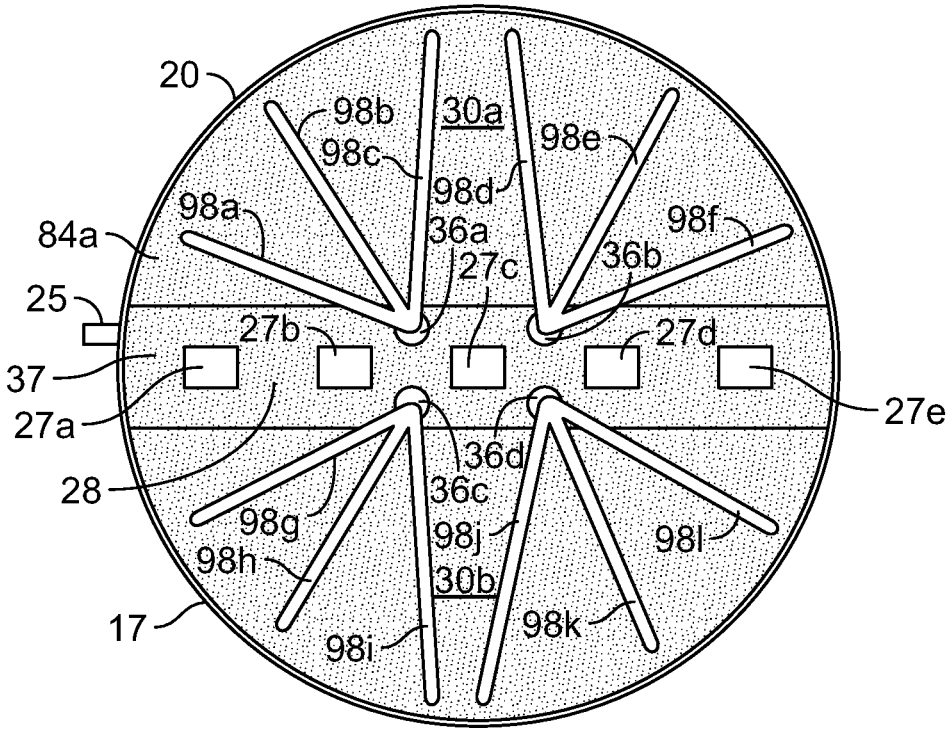
FIG. 31 is a top view of the Aeration Tube Arrangement within the Grain Silo according to one embodiment of the present invention.
Figure 32:
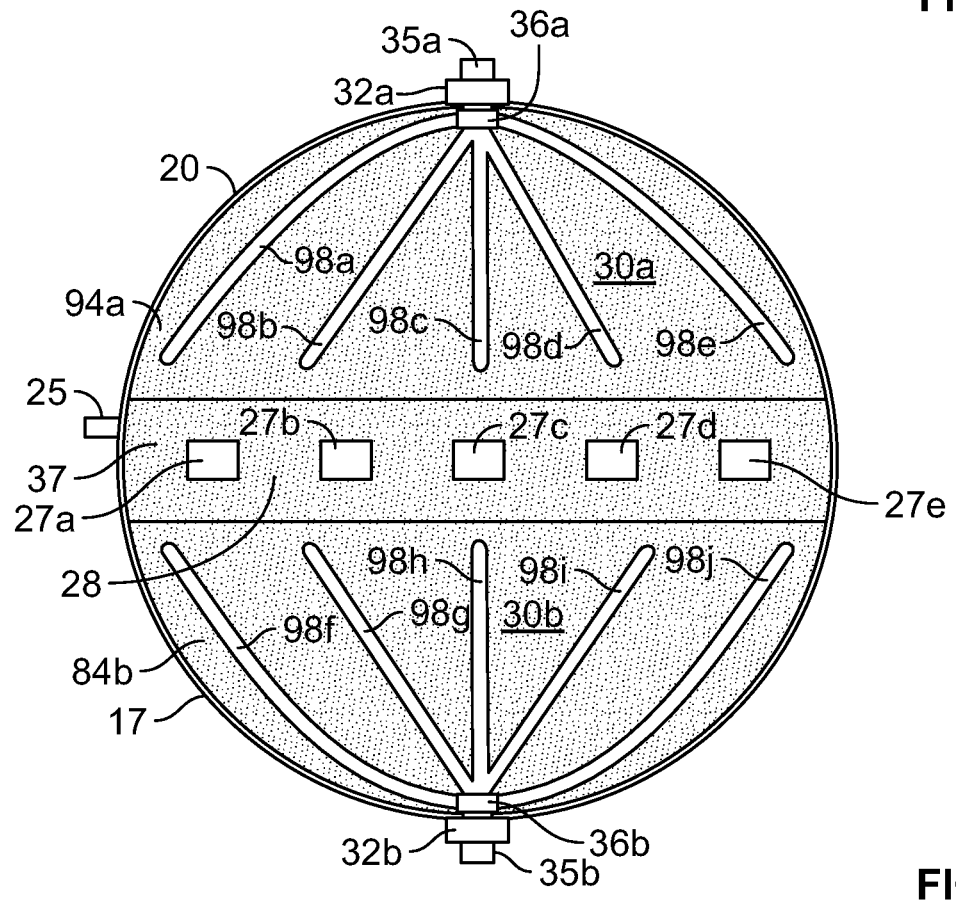
FIG. 32 is a top view of the Aeration Tube Arrangement within the Grain Silo according to one embodiment of the present invention.

FIGS. 31 and 32 show top views of grain silo 17 with aeration tube(s) 98 fixed to floor areas of inflate liner(s) 38 in different formations, according to several embodiments of the present invention. The purpose of the particular formation of aeration tubes 98 is to ensure aerating the grain in silo 17 beyond the area of the conveyor aeration assembly 37. In FIG. 31, the aeration air in the aeration tubes 98*a* to 98L is provided by the conveyor aeration assembly 37. As shown in FIG. 32, the aeration air is supplied to aeration tubes 98*a* to 98*e* by aeration exhaust coupling 36*a* connected to an aeration blower port 35*a* through a man-way opening 32*a* and matching opening assembly of liner. Also shown are aeration tubes 98*f* to 98*j* being supplied with aeration air from aeration blower (not shown) by an aeration blower port 35*b* connected to the aeration exhaust coupling 36*b* through wall of grain silo 17 and inflate liner 38 (not shown). One or more aeration blowers may be used with grain silo 17 to provide the necessary aeration to keep grain dry and conditioned properly during storage.

Figure 33:
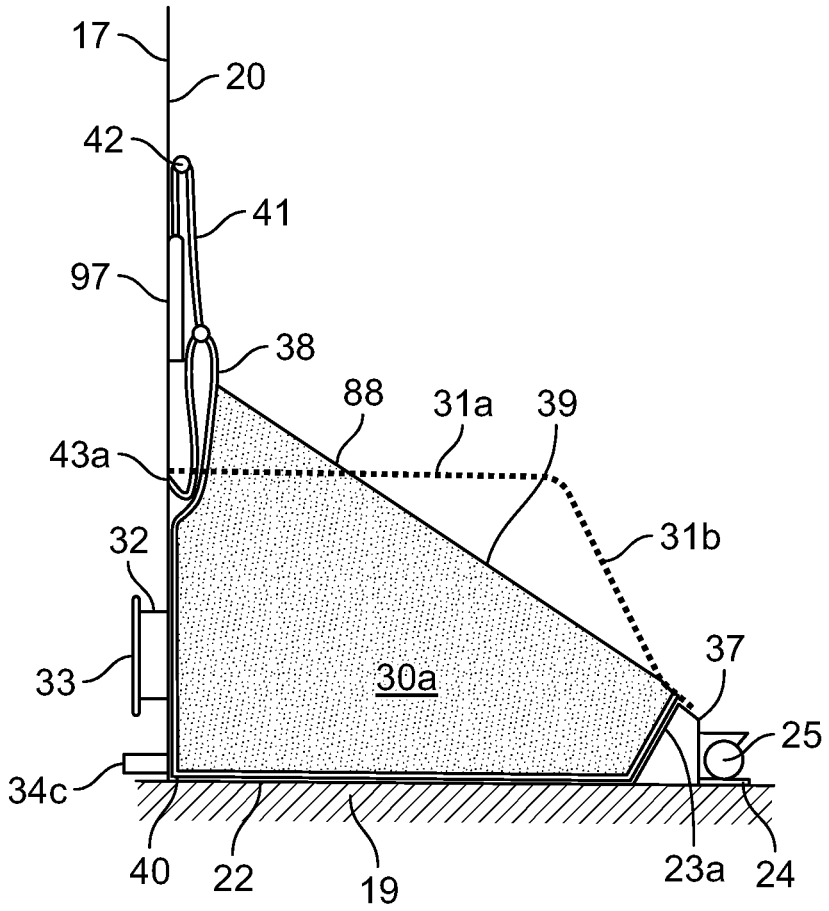
FIG. 33 is a side view of the Grain Silo with a Clamp Bar Assembly according to one embodiment of the present invention.

FIG. 33 is a side view of the grain silo 17 with a silo wall clamp bar assembly 31 according to one embodiment of the present invention. The clamp bar assembly 31 is mounted on silo wall 20 near or below angle of repose 88 of the grain 39. As shown, the inflate liner 38 rises above the silo clamp bar assembly 31*a* so as to roll and push grain as the liner 38 inflates. Mounting the silo wall clamp bar assembly 31*a* at a lower position creates a smaller air compartment 30*a* and aligns the clamp bar assembly 31*a* along the silo wall in a horizontal position. By forming the clamp bar assembly 31*a* into a horizontal position, a stronger seal is obtained. The horizontal alignment of the clamp bar assembly 31*a* ensures a stronger seal and reduces the downward pulling forces created when inflate liner 38 is near peak pressure inflation during the unloading process.

To keep inflate liner 38 positioned properly for the filling and unloading cycles in the grain silo 17, the inflate liner is equipped with one or more liner return anchor(s) 43, which secure one or more liner return cord(s) 41 by liner return pulley(s) 42 and one or more counterweight(s) 97. Counterweight(s) 97 may be located inside or outside of grain silo 17. Also, by placing the silo wall clamp bar 31*a* in a substantially horizontal position, well below the angle of repose 88 of grain 39, installing the inflate liner becomes easier and safer because the installation can be done without the use of lifts, scaffolding and extension ladders.

To provide access within liner air compartment 30*a*, a man-way opening 32 is installed on the silo wall 20 with a removable and air tight man-way cover 33. The man-way cover 33 may be made of clear Plexiglass and secured to man-way opening 32 by fasteners or a V-Band clamp. A liner inflation port 34*c* is attached to the silo wall 20 adjacent to a perforated pipe 40 for more efficient distribution of air during the inflation and deflation cycles. Liner return cord 41 may be made of rope, cable or bungee cord.

Figure 34:
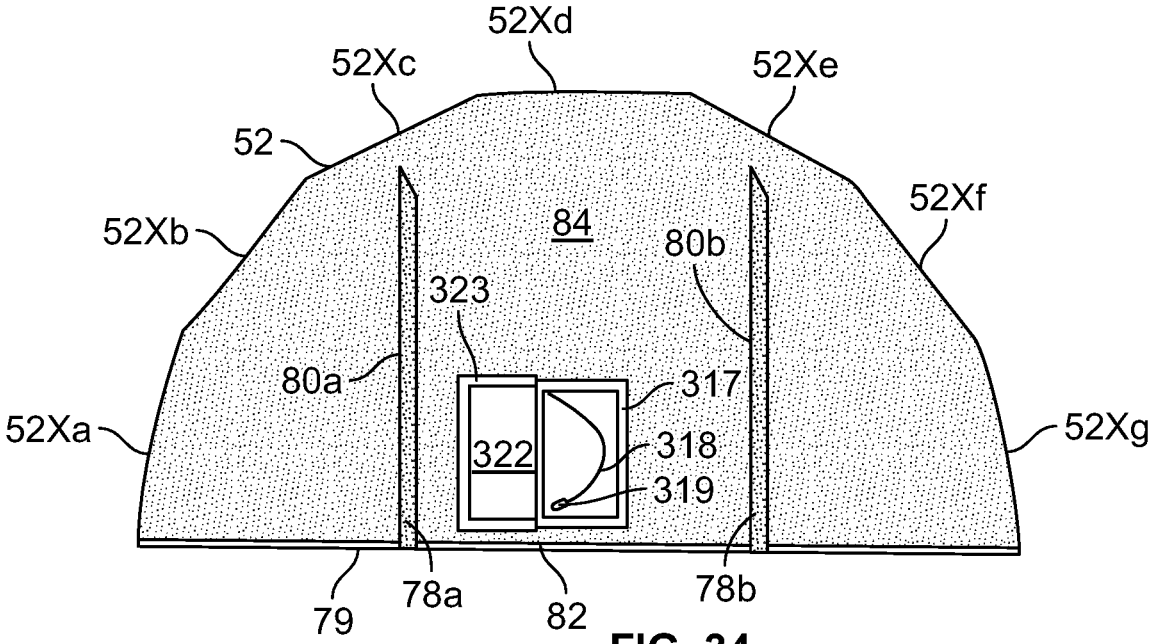
FIG. 34 is a top view of inflate liner floor panel according to one embodiment of the present invention.

FIG. 34 is a top view of inflate liner floor panel 84 according to one embodiment of the present invention. The inflate liner floor panel 84 includes inflate liner pleats 80*a* and 80*b* and floor to wall joints 52Xa-g formed as a plurality of straight edges. The straight edge design implemented with the floor-to-wall joints 52Xa-g provide stronger and more reliable heat-seals along the edge of the liner. The inflate liner floor panel 84 further comprises an entry panel 317 defining an access opening. The entry panel 317 has a zipper 318 that is opened by a zipper pull tab tab 319. Zipper 318 is also equipped with pull tab 319*b* (not shown) to provide a means of opening and closing zipper 318 from the bottom side of the liner inflate liner floor 84. An entry flap 322 is secured to inflate liner floor 84 to the side of the entry panel 317 at secured entry flap edge 324 to provide extra support to zipper 318 Consequently, the zipper 318 is not stressed during the inflation inflation process, in which pressure is generated on the inflate liner floor 84. As entry flap 322 is folded over against entry panel 317, an entry flap border 323 comprising hook-and-loop fastener is fastened to entry panel 317 outside the entry flap border 323 to provide added support and relieve pressure on zipper 318 during the inflation process. Zipper 318 may be opened and closed when inflate liner floor 84 is at rest, under vacuum or under pressure. The zipper 318, entry panel 317 and and entry panel cover 320 are located close to the conveyor edge 82, which is last section of the inflate liner floor 84 to lift off silo floor and exposed to very low pressure.

While the subject matter of this disclosure has been described and shown in considerable detail with reference to certain illustrative embodiments, including various combinations and sub-combinations of features, those skilled in the art will readily appreciate other embodiments and variations and modifications thereof as encompassed within the scope of the present disclosure. Moreover, the descriptions of such embodiments, combinations, and sub-combinations is not intended to convey that the claimed subject matter requires features or combinations of features other than those expressly recited in the claims. Accordingly, the scope of this disclosure is intended to include all modifications and variations encompassed within the spirit and scope of the following appended claims.

The invention claimed is:

1. A flexible liner system for a storage bin receiving and storing granular material, the flexible liner system comprising:

a first inflate liner and a second inflate liner, wherein each inflate liner is configured to be aligned along an interior surface of the storage bin, the first inflate liner opposes the second inflate liner within the storage bin, and the first inflate liner is separated from the second inflate liner by a central trough extending substantially completely across a floor of the storage bin, a conveyor assembly having a center well with one or more side wells positioned along the central trough of the storage bin, wherein the conveyor assembly is configured so that the center well is opened first for unloading before either of the inflate liners can be operated to receive free flowing granular material, a clamp bar assembly securing a first edge of each inflate liner to a wall of the storage bin, a second edge of each inflate liner secured adjacent to a respective edge of the conveyor assembly, and whereby each inflate liner defines a liner air compartment formed between a bottom surface of a respective inflate liner and the wall and floor of the storage bin and is configured to form an inflated wall extending parallel to the central trough that pushes the granular material toward the central trough.

2. The flexible liner system of claim 1, wherein the conveyor assembly includes an auger extending along the central trough and configured to receive the granular material from the collection wells and convey the granular material out of the storage bin.

3. The flexible liner system of claim 2, wherein conveyor assembly includes a first conveyor housing secured to the second edge of the first inflate liner and a second conveyor housing secured to the second edge of the second inflate liner, whereby the auger is installed between the first conveyor housing and the second conveyor housing.

4. The flexible liner system of claim 1, wherein each inflate liner is hemispherical-shaped that is aligned against a section of the wall and floor of the storage bin and has pleats folded and secured to the first edge of the inflate liner, whereby each pleat forms a linear reserve that allows each inflate liner to expand against the wall of the storage bin.

5. The flexible liner system of claim 1, wherein each inflate liner is capable of pushing the granular material toward the central trough at an air pressure between 0.15 PSI and 2 PSI.

6. The flexible liner system of claim 1, wherein each inflate liner is configured to be pressed against the wall of the storage bin to form a liner wall along the wall of the storage bin and a liner floor along the floor of the storage bin, whereby the liner wall is separated by the liner floor by a liner floor to wall joint and the liner floor further defines a liner trough edge along the second end of the liner, wherein a length of the liner floor to wall joint is about 1.5 times longer than line of the liner trough edge.

7. The flexible liner system of claim 1 further comprising a liner return system configured to return each inflate liner back against the wall and floor of the storage bin during deflation of the inflate liners.

8. The flexible liner system of claim 1, wherein the conveyor assembly is configured to aerate the granular material stored in the storage bin.

9. The flexible liner system of claim 8, wherein each conveyor housing defines an aeration housing conduit that is pressurized with air by an aeration blower and the conveyor aeration assembly further includes aeration exhaust couplings to aerate the granular material stored in the storage bin and the conveyor assembly further includes aeration tubes attached to a respective inflate liner and extending from the conveyor housing toward the wall of the storage bin.

10. The flexible liner system of claim 1, wherein the clamp bar assembly further includes a clamp bar mounting plate, a clamp bar, a flexible shield and a stud bolt extending through both the clamp bar mounting plate and the clamp bar and a mounting plate hole of the silo wall, whereby the second edge of the liner is secured between the clamp bar and the clamp bar mounting plate and the flexible shield is applied between the clamp bar mounting plate and the second edge of the liner to maintain an air-tight seal between the liner and the silo wall.

11. A storage bin for receiving and storing granular material, the storage bin comprising:

a floor, a roof, and a cylindrical wall extending between the floor and the roof to define a storage space for the granular material, a flexible liner system installed within the storage bin, the flexible liner system comprising:

a first inflate liner and a second inflate liner, wherein each inflate liner is configured to be aligned along the floor and cylindrical wall of the storage bin, the first inflate liner opposes the second inflate liner within the storage bin, and the first inflate liner is separated from the second inflate liner by a central trough extending substantially completely across a floor of the storage bin, a conveyor assembly positioned along the central trough of the storage bin, wherein the conveyor assembly is configured to receive free flowing granular material and discharge the granular material from the storage bin, a clamp bar assembly securing a first edge of each inflatable liner to the cylindrical wall of the storage bin, a second edge of each inflatable liner secured adjacent to a respective edge of the conveyor assembly, and whereby each inflate liner defines a liner air compartment formed between a bottom surface of a respective inflate liner and the wall and floor of the storage bin and is configured to form an inflated wall extending parallel to the central trough that pushes the granular material toward the central trough, wherein the conveyor assembly includes an auger extending along the central trough and configured to receive and convey the granular material out of the storage bin, a first conveyor housing secured to the second edge of the first inflate liner, and a second conveyor housing secured to the second edge of the second inflate liner, whereby the auger is installed in between the first conveyor housing and the second conveyor housing.

12. A storage bin for receiving and storing granular material, the storage bin comprising:

a floor, a roof, and a cylindrical wall extending between the floor and the roof to define a storage space for the granular material, a flexible liner system installed within the storage bin, the flexible liner system comprising:

a first inflate liner and a second inflate liner, wherein each inflate liner is configured to be aligned along the floor and cylindrical wall of the storage bin, the first inflate liner opposes the second inflate liner within the storage bin, and the first inflate liner is separated from the second inflate liner by a central trough extending substantially completely across a floor of the storage bin, a conveyor assembly positioned along the central trough of the storage bin, wherein the conveyor assembly is configured to receive free flowing granular material and discharge the granular material from the storage bin, a clamp bar assembly securing a first edge of each inflatable liner to the cylindrical wall of the storage bin, a second edge of each inflatable liner secured adjacent to a respective edge of the conveyor assembly, and whereby each inflate liner defines a liner air compartment formed between a bottom surface of a respective inflate liner and the wall and floor of the storage bin and is configured to form an inflated wall extending parallel to the central trough that pushes the granular material toward the central trough wherein each inflate liner is hemispherical-shaped that is aligned against a section of the wall and floor of the storage bin and has one or more pleats folded and secured to the first edge of the inflate liner; whereby each pleat forms a linear reserve that allows each inflate liner to expand against the wall of the storage bin.

13. A storage bin for receiving and storing granular material, the storage bin comprising:

a floor, a roof, and a cylindrical wall extending between the floor and the roof to define a storage space for the granular material, a flexible liner system installed within the storage bin, the flexible liner system comprising:

a first inflate liner and a second inflate liner, wherein each inflate liner is configured to be aligned along the floor and cylindrical wall of the storage bin, the first inflate liner opposes the second inflate liner within the storage bin, and the first inflate liner is separated from the second inflate liner by a central trough extending substantially completely across a floor of the storage bin, a conveyor assembly positioned along the central trough of the storage bin, wherein the conveyor assembly is configured to receive free flowing granular material and discharge the granular material from the storage bin, a clamp bar assembly securing a first edge of each inflatable liner to the cylindrical wall of the storage bin, a second edge of each inflatable liner secured adjacent to a respective edge of the conveyor assembly, and whereby each inflate liner defines a liner air compartment formed between a bottom surface of a respective inflate liner and the wall and floor of the storage bin and is configured to form an inflated wall extending parallel to the central trough that pushes the granular material toward the central trough wherein the flexible liner system comprises a liner return system configured to return each inflate liner back against the wall and floor of the storage bin during deflation of the inflate liners.

14. A storage bin for receiving and storing granular material, the storage bin comprising:

a floor, a roof, and a cylindrical wall extending between the floor and the roof to define a storage space for the granular material, a flexible liner system installed within the storage bin, the flexible liner system comprising:

a first inflate liner and a second inflate liner, wherein each inflate liner is configured to be aligned along the floor and cylindrical wall of the storage bin, the first inflate liner opposes the second inflate liner within the storage bin, and the first inflate liner is separated from the second inflate liner by a central trough extending substantially completely across a floor of the storage bin, a conveyor assembly positioned along the central trough of the storage bin, wherein the conveyor assembly is configured to receive free flowing granular material and discharge the granular material from the storage bin, a clamp bar assembly securing a first edge of each inflatable liner to the cylindrical wall of the storage bin, a second edge of each inflatable liner secured adjacent to a respective edge of the conveyor assembly, and whereby each inflate liner defines a liner air compartment formed between a bottom surface of a respective inflate liner and the wall and floor of the storage bin and is configured to form an inflated wall extending parallel to the central trough that pushes the granular material toward the central trough wherein each inflate liner is configured to be pressed against the wall of the storage bin to form a liner wall along the wall of the storage bin and a liner floor along the floor of the storage bin, whereby the liner wall is separated by the liner floor by a liner floor to wall joint.

15. The storage bin of claim 13, wherein the liner floor further defines a liner trough edge along the second end of the inflate liner and a length of the liner floor to wall joint is about 1.5 times longer than line of the liner trough edge.

16. The storage bin of claim 11, wherein the conveyor assembly is configured to aerate the granular material stored in the storage bin.

17. The storage bin of claim 11, wherein the clamp bar assembly further includes a clamp bar mounting plate, a clamp bar, a flexible shield and a stud bolt extending through both the clamp bar mounting plate and the clamp bar and a mounting plate hole of the silo wall, whereby the second edge of the liner is secured between the clamp bar and the clamp bar mounting plate and the flexible shield is applied between the clamp bar mounting plate and the second edge of the liner to maintain an air-tight seal between the liner and the silo wall.

18. A storage bin for receiving and storing granular material, the storage bin comprising:

a floor, a roof, and a cylindrical wall extending between the floor and the roof to define a storage space for the granular material, a flexible liner system installed within the storage bin, the flexible liner system comprising:

a first inflate liner and a second inflate liner, wherein each inflate liner is configured to be aligned along the floor and cylindrical wall of the storage bin, the first inflate liner opposes the second inflate liner within the storage bin, and the first inflate liner is separated from the second inflate liner by a central trough extending substantially completely across a floor of the storage bin, a conveyor assembly positioned along the central trough of the storage bin, wherein the conveyor assembly is configured to receive free flowing granular material and discharge the granular material from the storage bin, a clamp bar assembly securing a first edge of each inflatable liner to the cylindrical wall of the storage bin, a second edge of each inflatable liner secured adjacent to a respective edge of the conveyor assembly, and whereby each inflate liner defines a liner air compartment formed between a bottom surface of a respective inflate liner and the wall and floor of the storage bin and is configured to form an inflated wall extending parallel to the central trough that pushes the granular material toward the central trough, wherein the conveyor assembly includes an auger extending along the central trough and configured to receive and convey the granular material out of the storage bin, and the auger comprises a plurality of collection wells to receive the free flowing granular material and a plurality of collection valves configured to open or close the collection wells, the plurality of collection wells includes a central well position between at least two side wells positioned along the central trough and the plurality of collection valves are configured to close each side well and open the central well at the beginning of an unloading process.

19. A storage bin for receiving and storing granular material, the storage bin comprising:

a floor, a roof, and a cylindrical wall extending between the floor and the roof to define a storage space for the granular material, a flexible liner system installed within the storage bin, the flexible liner system comprising:

a first inflate liner and a second inflate liner, wherein each inflate liner is configured to be aligned along the floor and cylindrical wall of the storage bin, the first inflate liner opposes the second inflate liner within the storage bin, and the first inflate liner is separated from the second inflate liner by a central trough extending substantially completely across a floor of the storage bin, a conveyor assembly positioned along the central trough of the storage bin, wherein the conveyor assembly is configured to receive free flowing granular material and discharge the granular material from the storage bin, a clamp bar assembly securing a first edge of each inflatable liner to the cylindrical wall of the storage bin, a second edge of each inflatable liner secured adjacent to a respective edge of the conveyor assembly, and whereby each inflate liner defines a liner air compartment formed between a bottom surface of a respective inflate liner and the wall and floor of the storage bin and is configured to form an inflated wall extending parallel to the central trough that pushes the granular material toward the central trough, wherein the clamp bar assembly is mounted at a position along the wall of the storage bin that is below the angle of repose of the granular material, thereby placing the clamp bar assembly at a substantially horizontal position with respect to the wall of the storage bin.

20. The storage bin of claim 17, wherein the clamp bar assembly further includes a gasket between the clamp bar mounting plate and the wall of the storage bin.

* * * * *